US008210537B1

(12) United States Patent
Ladhe et al.

(10) Patent No.: US 8,210,537 B1
(45) Date of Patent: Jul. 3, 2012

(54) MULTI-GRID TIC-TAC-TOE GAME

(76) Inventors: Pankaj S. Ladhe, Morrisville, NC (US); Manish P. Maheshwari, Morrisville, NC (US)

( * ) Notice: Subject to any disclaimer, the term of this patent is extended or adjusted under 35 U.S.C. 154(b) by 0 days.

(21) Appl. No.: 13/014,890

(22) Filed: Jan. 27, 2011

Related U.S. Application Data

(60) Provisional application No. 61/299,412, filed on Jan. 29, 2010.

(51) Int. Cl.
*A63F 9/24* (2006.01)

(52) U.S. Cl. ..... 273/271; 463/9

(58) Field of Classification Search ..... 463/9; 273/271
See application file for complete search history.

(56) References Cited

U.S. PATENT DOCUMENTS

| | | | | |
|---|---|---|---|---|
| D172,796 | S * | 8/1954 | Kaye et al. | D21/336 |
| 3,464,701 | A * | 9/1969 | Mahoney | 273/241 |
| 3,556,526 | A * | 1/1971 | Currie | 273/239 |
| 3,588,113 | A | 6/1971 | Nelson | |
| 3,747,926 | A | 7/1973 | Odom | |
| 3,879,040 | A * | 4/1975 | Smith | 273/241 |
| 3,889,953 | A | 6/1975 | Grasham | |
| 4,371,169 | A * | 2/1983 | Compton | 273/271 |
| 5,249,805 | A * | 10/1993 | Neil et al. | 463/10 |
| 6,254,098 | B1 * | 7/2001 | Kirkpatrick | 273/271 |

* cited by examiner

*Primary Examiner* — Corbett B Coburn
(74) *Attorney, Agent, or Firm* — Coats & Bennett, P.L.L.C.

(57) ABSTRACT

A multi-grid tic-tac-toe game herein requires players to strategically plan moves in advance. An associated game apparatus includes a plurality of individual tic-tac-toe grids. Each grid includes playing areas that receive playing pieces. At least one of the grids shares at least one common playing area with another one of the grids. To play, different players use different sets of playing pieces. The players take turns placing their pieces in different playing areas, attempting to form tic-tac-toes. A player forms a tic-tac-toe if he or she places a predetermined number of pieces in a corresponding number of adjacent playing areas that are aligned, irrespective of whether those playing areas belong to different grids. Points are awarded for each tic-tac-toe, and are accumulated over the course of the game. The game apparatus may include a mechanism for tracking each player's points. The winner is the player with the most points accumulated.

25 Claims, 24 Drawing Sheets

MULTI-GRID TIC-TAC-TOE GAME

TECHNICAL FIELD

The present invention relates generally to strategy games, and more particularly to tic-tac-toe related games.

BACKGROUND

The traditional game of tic-tac-toe is a simple, readily learned game. Little playing strategy is required. As a result, traditional tic-tac-toe does not appeal to a large number of people. And those who do play the game seldom play it more than a few times in succession, since only a minimal level of challenge is presented.

The game of chess, on the other hand, is a highly sophisticated and complex game. A lengthy period of time is required to complete a single game. For these reasons, chess is played mainly by a comparatively small number of highly devoted and motivated followers of the game. Chess therefore fails to appeal to the masses for different reasons than tic-tac-toe.

U.S. Pat. No. 3,879,040 (Smith) discloses a three dimensional tic-tac-toe game apparatus. The three dimensional nature of the game adds complexity and sophistication to tic-tac-toe. This in turn stimulates player interest and increases the market appeal of the game beyond that of the basic tic-tac-toe game. However, three dimensional tic-tac-toe still falls far short of the complexity and mental challenge which are intrinsic to the game of chess.

Other adaptations and modifications of the basic tic-tac-toe game are shown in U.S. Pat. Nos. 3,588,113 (Nelson), 3,747,926 (Odom), 3,889,953 (Grasham). Each of these three tic-tac-toe modifications adds further complexity to stimulate player interest and enjoyment of the game.

Yet none of these known tic-tac-toe games are played on a conventional two dimensional board and require that a player plan one more ahead in order to successfully produce score generating combinations of playing pieces on the board. This requirement for planning at least one move ahead would vastly increase the enjoyment and challenge of tic-tac-toe without substantially increasing the amount of time required to complete a single game.

SUMMARY

Embodiments herein include a multi-grid tic-tac-toe game that can be played on a conventional two-dimensional board and that requires players to strategically plan tic-tac-toe moves in advance. Moreover, the multi-grid tic-tac-toe game can be played by more than just two people (e.g., three or four), and can even be played in teams. These features increase the enjoyment and challenge of tic-tac-toe as compared to the traditional version, without substantially increasing the amount of time required to complete a single game.

The multi-grid tic-tac-toe game may be embodied as a game apparatus. The game apparatus includes a plurality of individual tic-tac-toe grids. Each individual grid in turn includes a plurality of playing areas. These playing areas are configured to receive playing pieces. At least one of the individual tic-tac-toe grids shares at least one common playing area with another one of the individual tic-tac-toe grids.

In some embodiments, the individual grids include a plurality of peripheral tic-tac-toe grids as well as a central tic-tac-toe grid. The central grid shares at least one common playing area with each peripheral grid. These peripheral grids may be spaced apart from one another, so that the peripheral grids themselves do not share common playing areas with one another. Alternatively, common playing areas may be shared between different peripheral grids.

Regardless, in a multi-grid tic-tac-toe game between players, different players use different sets of playing pieces, e.g., distinguished by color, size, shape, or the like. The players take turns placing playing pieces from their respective sets on or in different playing areas. In making these moves, each player attempts to form one or more so-called "tic-tac-toes" with their respective playing pieces, or to prevent an opponent from doing so.

A player forms a tic-tac-toe as used herein if he or she places a predetermined number of playing pieces (e.g., three) in a corresponding number of adjacent playing areas that are aligned. Notably, these playing areas do not need to belong to a single individual tic-tac-toe grid, but instead may belong to different individual tic-tac-toe grids. A tic-tac-toe may therefore extend across different individual grids. This feature, in conjunction with the relatively large number and arrangement of playing areas, contributes to the sophistication and complexity of multi-grid tic-tac-toe.

Notably, according to some embodiments, a game between players does not necessarily end when one player forms a tic-tac-toe. Instead, the game awards points to respective players for tic-tac-toes formed, and accumulates each player's points over one or more tic-tac-toes. The winner is the player with the most points accumulated, e.g., when playing pieces have been placed on all of the playing areas. This feature likewise contributes to the sophistication and complexity of multi-grid tic-tac-toe, and further facilitates play by more than two players.

The multi-grid tic-tac-toe game may alternatively be embodied as a computer program product, as detailed herein.

Of course, the present invention is not limited to the above features and advantages. Indeed, those skilled in the art will recognize additional features and advantages upon reading the following detailed description, and upon viewing the accompanying drawings.

BRIEF DESCRIPTION OF THE DRAWINGS

FIG. 1 also depicts a tic-tac-toe playing piece (e.g., a peg) configured for use with the game apparatus.

DETAILED DESCRIPTION

Figure 1:
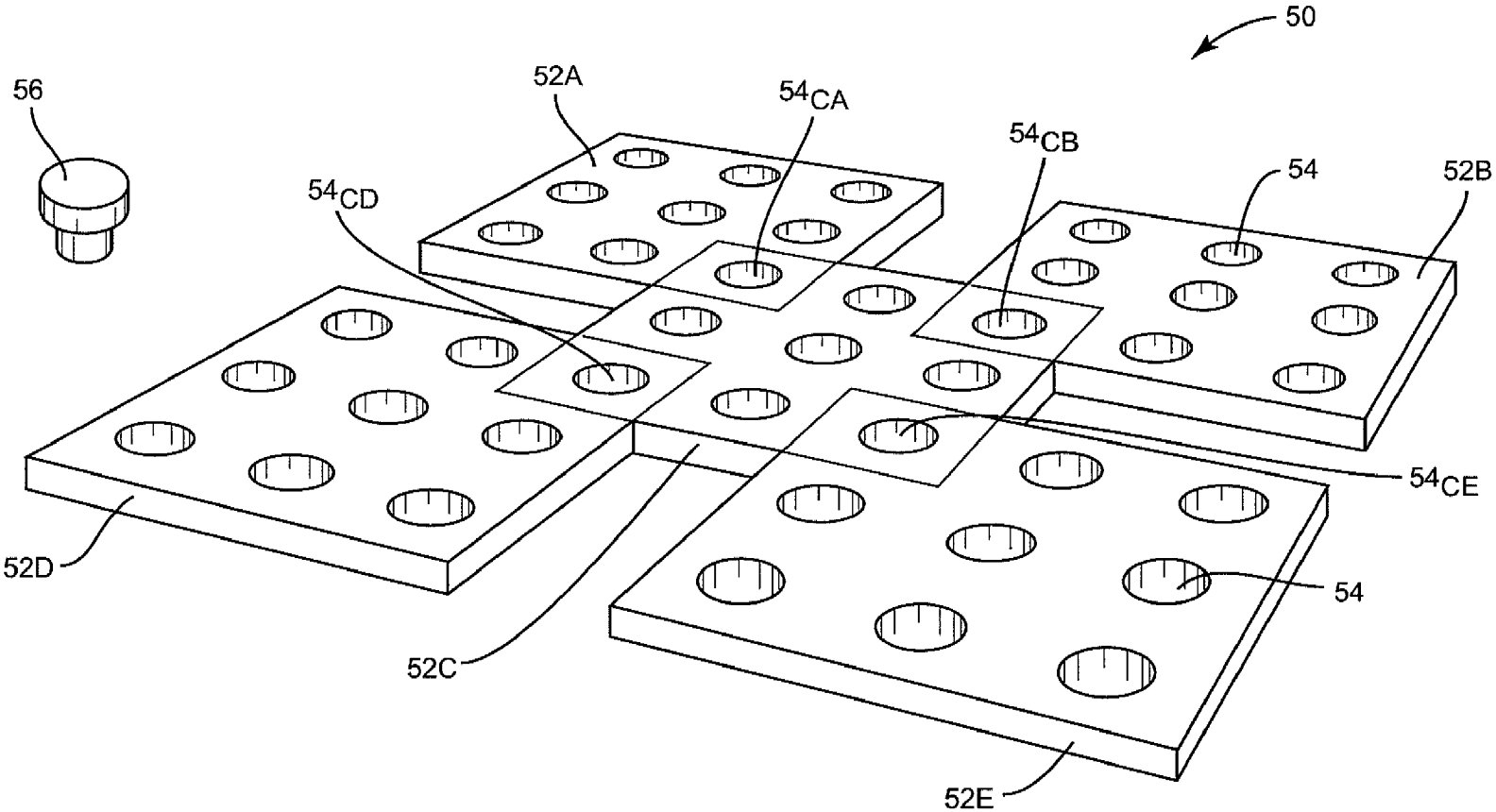
FIG. 1 shows an isometric view of a multi-grid tic-tac-toe game apparatus according to one or more embodiments.

FIG. 1 illustrates a multi-grid tic-tac-toe game apparatus 50 according to one or more embodiments. The game apparatus 50 comprises a plurality of individual tic-tac-toe grids 52 (e.g., two or more). FIG. 1 depicts an exemplary apparatus 50 with five individual tic-tac-toe grids labeled for convenience from 352A-52E.

Each of the individual tic-tac-toe grids 52 includes a plurality of playing areas 54. These playing areas 54 are configured to receive playing pieces 56. In at least one embodiment, for example, the playing pieces 56 comprise pegs and the playing areas 54 comprise apertures or openings configured to receive those pegs. Regardless, at least one of the individual tic-tac-toe grids 52 shares at least one common playing area 54 with another one of the individual tic-tac-toe grids 52.

In some embodiments, an individual tic-tac-toe grid 52 shares a common playing area 54 with another individual tic-tac-toe grid 52 in the sense that the common playing area 54 is a playing area 54 of both grids 52. As shown in FIG. 1, for example, grid 52C and grid 52E share common playing area $\mathbf{54}_{CE}$. This common playing area $\mathbf{54}_{CE}$ is a playing area 54 of both grids 52C and 52E. More particularly, the common playing area $\mathbf{54}_{CE}$ is a corner playing area of both grids 52C and 52E.

With a common playing area 54 being a playing area of multiple grids 52, that common playing area 54 contributes to those grids 52 each having a predetermined number of playing areas 54. Again using FIG. 1 as an example, common playing area $\mathbf{54}_{CE}$ contributes to both grid 52C and 52E having nine playing areas 54 each.

An individual tic-tac-toe grid 52 in other embodiments shares a common playing area 54 with another individual tic-tac-toe grid 52 in the sense that the grids 52 overlap, in part. Each grid 52 in such embodiments includes a number of playing areas 54 arranged in rows (e.g., as shown in FIG. 1, each grid 52 includes nine playing areas 54 arranged in three rows of three playing areas 54 each). Grids 52 that overlap have intersecting rows of playing areas 54. A playing area 54 included in this intersection is a common playing area 54.

Of course, the game apparatus 50 may have more than just a single common playing area 54. For example, two individual tic-tac-toe grids 52 may share more than one common playing area 54. Alternatively or additionally, the game apparatus 50 may include three or more grids 52, with at least one grid 52 sharing a common playing area 54 with each of the other grids 52. FIG. 1 illustrates this latter case well, with an exemplary apparatus 50 that includes five grids 52. In FIG. 1, one individual tic-tac-toe grid 52, namely grid 52C, shares a common playing area 54 with each of the other individual tic-tac-toe grids 52. Specifically, grid 52C shares playing area $\mathbf{54}_{CA}$ with grid 52A, playing area $\mathbf{54}_{CB}$ with grid 52B, playing area $\mathbf{54}_{CD}$ with grid 52D, and playing area $\mathbf{54}_{CE}$ with grid 52E.

FIG. 1 also illustrates embodiments of the game apparatus 50 where the individual tic-tac-toe grids 52 include a plurality of peripheral tic-tac-toe grids 52A, 52B, 52D, 52E as well as a central tic-tac-toe grid 52C. This central grid 52C is disposed in the center of the peripheral grids 52A, 52B, 52D, and 52E, and correspondingly shares at least one common playing area 54 with each peripheral grid.

In some embodiments, the peripheral grids 52A, 52B, 52D, and 52E are spaced apart from one another. That is, although the central grid 52C shares a common playing area 54 with each peripheral grid, the peripheral grids 52A, 52B, 52D, and 52E themselves do not share common playing areas 54 with one another. Moreover, playing areas 54 of different peripheral grids 52A, 52B, 52D, and 52E are not adjacent to one another.

FIG. 1 depicts a simple example of these embodiments using a central tic-tac-toe grid 52C with three rows of three playing areas 54 each. In order for the peripheral grids 52A, 52B, 52D, and 52E to be spaced apart from one another in this example, the peripheral grids are disposed at different corners of the central grid 52C. Also, each peripheral grid 52A, 52B, 52D, and 52E shares just one common playing area with the central grid 52C, e.g., $\mathbf{54}_{CA}$, $\mathbf{54}_{CA}$, $\mathbf{54}_{CD}$, and $\mathbf{54}_{CE}$, respectively. Each of these common playing areas is thus a corner playing area 54.

Accordingly, the individual tic-tac-toe grids 52 in FIG. 1 collectively include forty-one playing areas 54. Four of those playing areas 54, namely $\mathbf{54}_{CA}$, $\mathbf{54}_{CA}$, $\mathbf{54}_{CD}$, and $\mathbf{54}_{CE}$, are common playing areas 54 that are shared between four different pairs of individual tic-tac-toe grids 52. With respect to the central grid 52C, these four playing areas $\mathbf{54}_{CA}$, $\mathbf{54}_{CA}$, $\mathbf{54}_{CD}$, and $\mathbf{54}_{CE}$ comprise outer corner playing areas. Yet with respect to each peripheral grid 52A, 52B, 52D, and 52E, the four playing areas $\mathbf{54}_{CA}$, $\mathbf{54}_{CA}$, $\mathbf{54}_{CD}$, and $\mathbf{54}_{CE}$ comprise inner corner playing areas.

Another feature of the individual tic-tac-toe grids 52 in FIG. 1 is that the grids 52 comprise two diagonal lines of playing areas 54. Each of these diagonal lines includes seven aligned playing areas 54 that span two of the peripheral grids and the central grid. The grids 52 also comprise four parallel lines of playing areas 54. Each of these parallel lines includes seven aligned playing areas 54 that span two of the peripheral grids and the central grid.

With the game apparatus 50 configured in this way, the apparatus 50 is used for playing a quite sophisticated version of tic-tac-toe. The game can be played on a conventional two-dimensional board and requires players to strategically plan moves in advance. Moreover, the game can be played by more than just two people (e.g., three or four), and can be played in teams. These features increase the enjoyment and challenge of tic-tac-toe compared to the traditional version, without substantially increasing the amount of time required to complete a single game.

In a game between players, different players use different sets of playing pieces 56, e.g., distinguished by color, size, shape, or the like. The players take turns placing playing pieces 56 from their respective sets on or in different playing areas 54. Specifically, with each turn, each player places one playing piece 56 in one playing area 54 that does not already have a playing piece 56 disposed therein. In making these moves, each player attempts to form one or more so-called "tic-tac-toes" with their respective playing pieces 56, or to prevent an opponent from doing so.

A player forms a tic-tac-toe as used herein if he or she places a predetermined number of playing pieces 56 (e.g., three) in a corresponding number of adjacent playing areas 54 that are aligned. Notably, these playing areas 54 do not need to belong to a single individual tic-tac-toe grid 52, but instead may belong to different individual tic-tac-toe grids 52. A tic-tac-toe may therefore extend across different individual grids 52. This feature, in conjunction with the relatively large number and arrangement of playing areas 54, contributes to the sophistication and complexity of the game.

Figure 2:
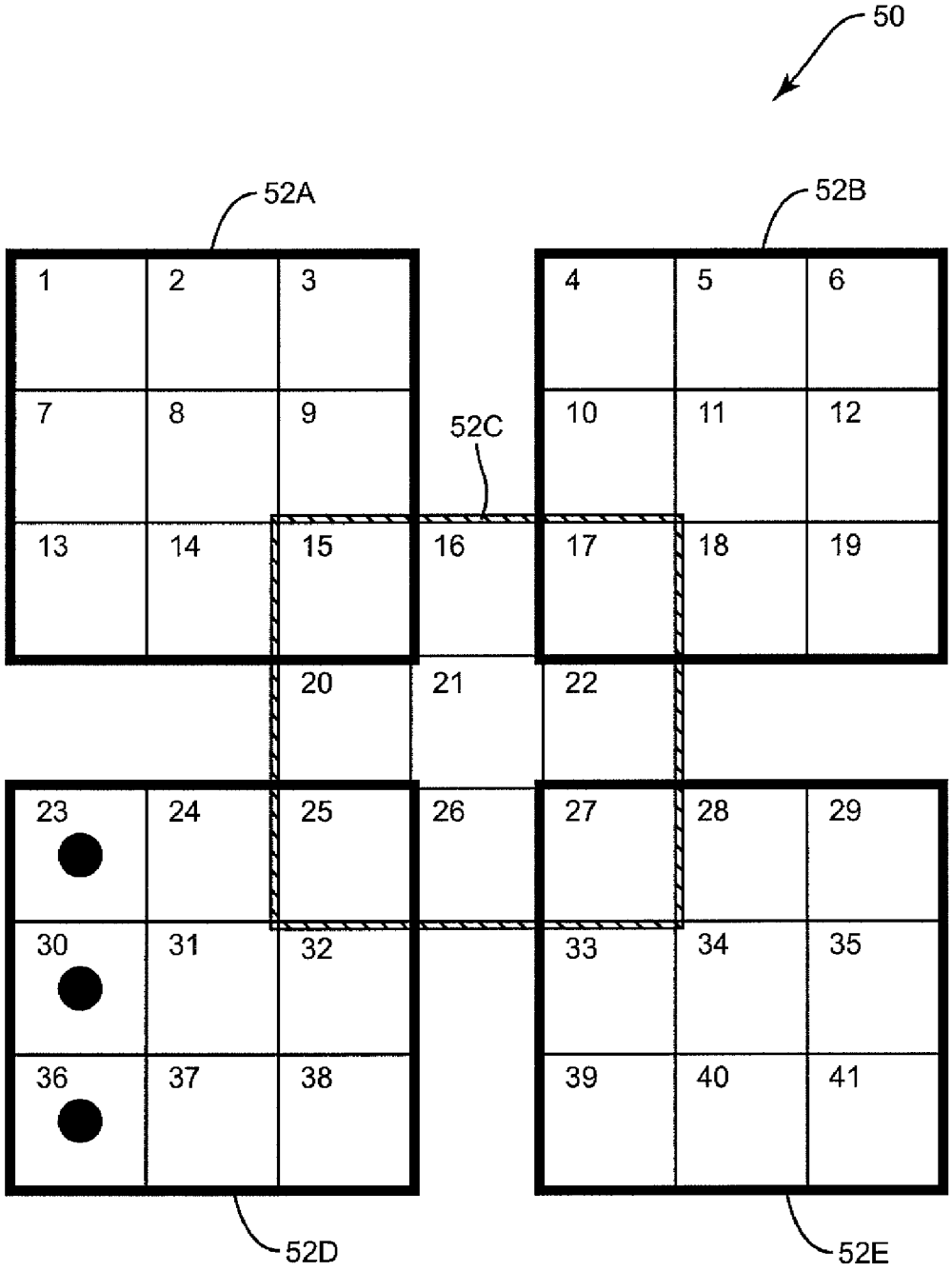
FIGS. 2-4 illustrate different examples of playing piece placements that result in a tic-tac-toe, according to some embodiments.
Figure 3:
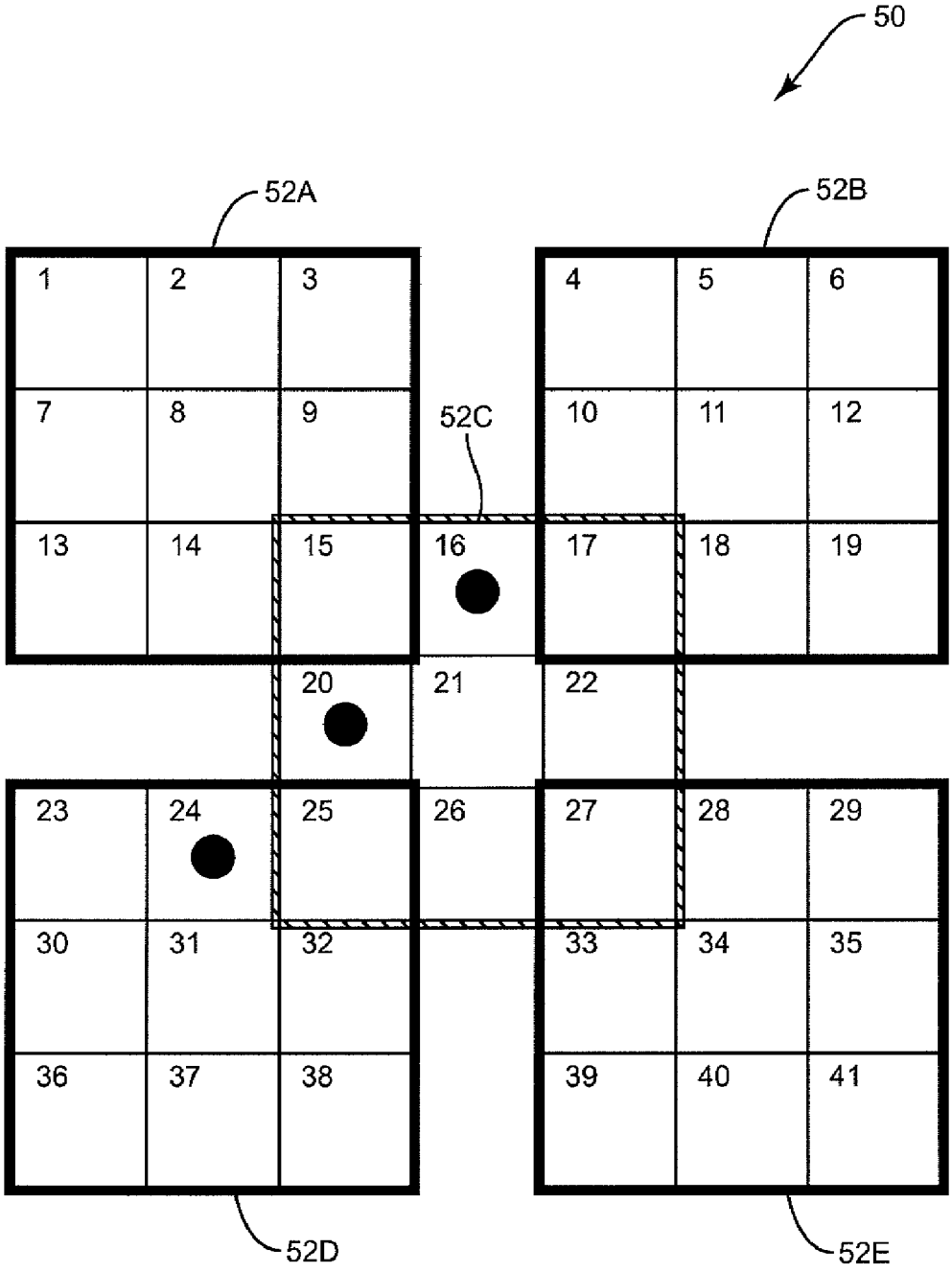
Figure 4:
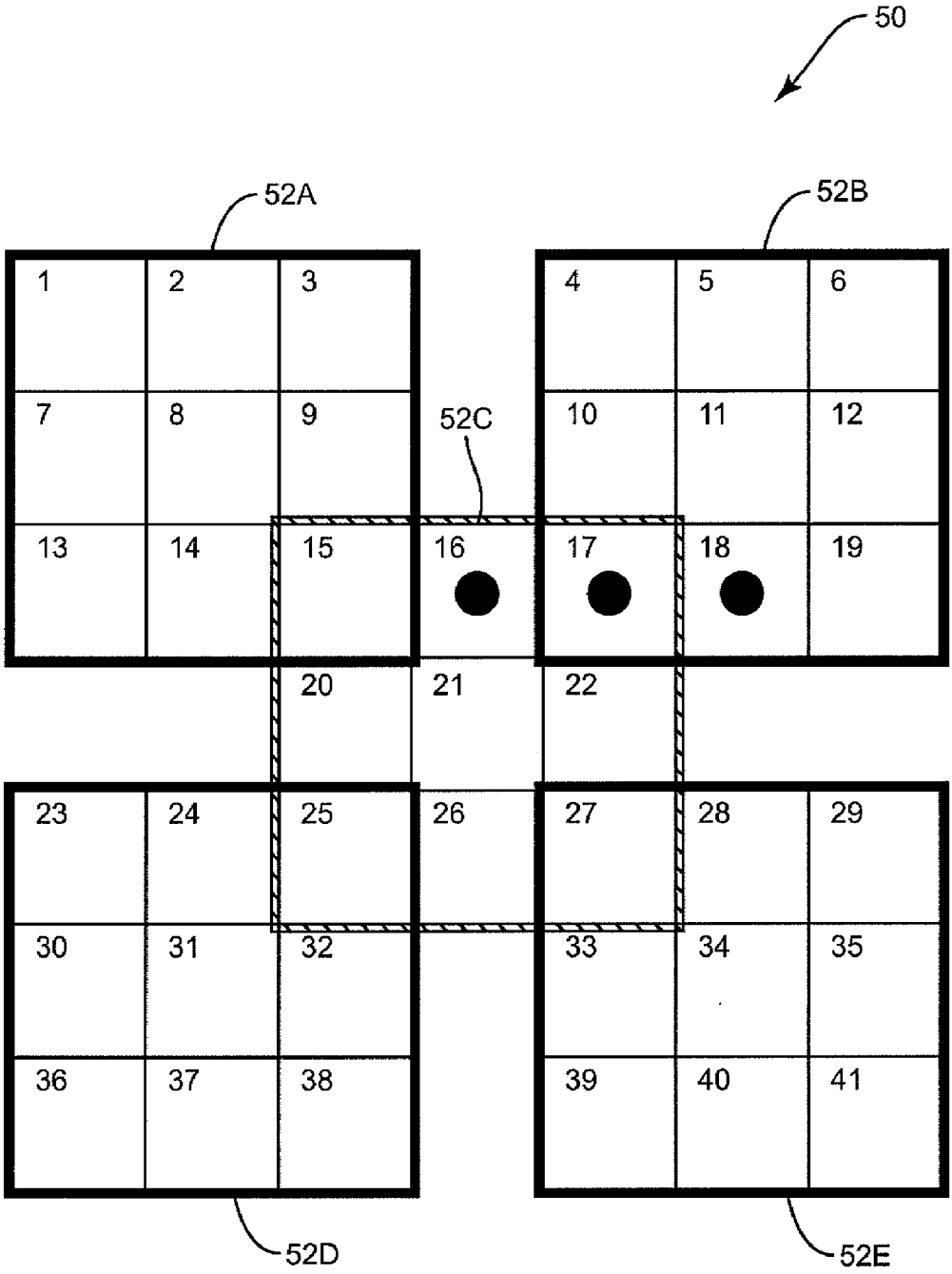

FIGS. 2-4 illustrate different examples of tic-tac-toes consistent with the above. In these figures, and some of the succeeding figures, playing areas 54 are numbered from 1-41 for convenience. Also in these figures, the playing pieces 56 are illustrated as round circles and are presumed to be the playing pieces 56 of one player. In this regard, the figures are purely illustrative, as during an actual game different playing pieces 56 from multiple different players would be placed on the apparatus 50. Finally, the figures illustrate a tic-tac-toe as being formed from three playing pieces 56 in three playing areas 54.

FIG. 2 shows a tic-tac-toe formed from a player having placed three playing pieces 56 in three adjacent playing areas 23, 30, and 36 that are vertically aligned in a column. These playing areas 23, 30, and 36 belong to the same individual tic-tac-toe grid, namely grid 52D. FIG. 3 by contrast shows a tic-tac-toe that extends across different individual grids 52. In FIG. 3, a tic-tac-toe is formed from a player having placed three playing pieces 56 in three adjacent playing areas 16, 20, and 24 that are diagonally aligned. Notably, some of these playing areas belong to different individual grids 52, namely grid 52C and 52D. FIG. 4 shows a tic-tac-toe that extends across different individual grids 52 using a common playing area. In FIG. 4, a tic-tac-toe is formed from a player having placed three playing pieces 56 in three adjacent playing areas 16, 17, and 18 that are horizontally aligned in a row. Some of these playing areas belong to different individual grids 52, namely grid 52C and 52B. Moreover, playing area 17 is a common playing area that is shared between those grids 52C and 52B.

Figure 5:
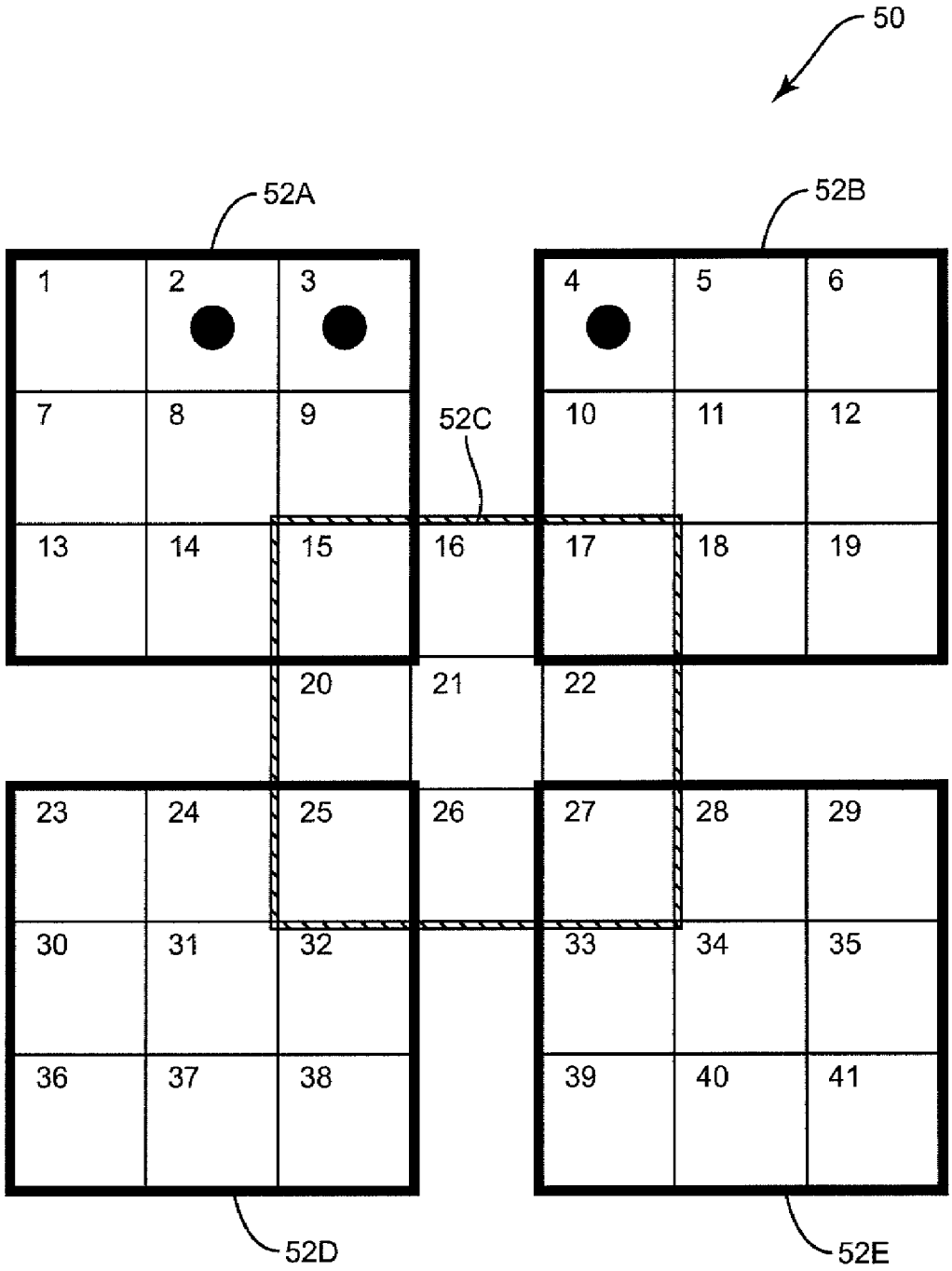
FIGS. 5-7 illustrate different examples of playing piece placements that do not result in a tic-tac-toe, according to some embodiments.
Figure 6:
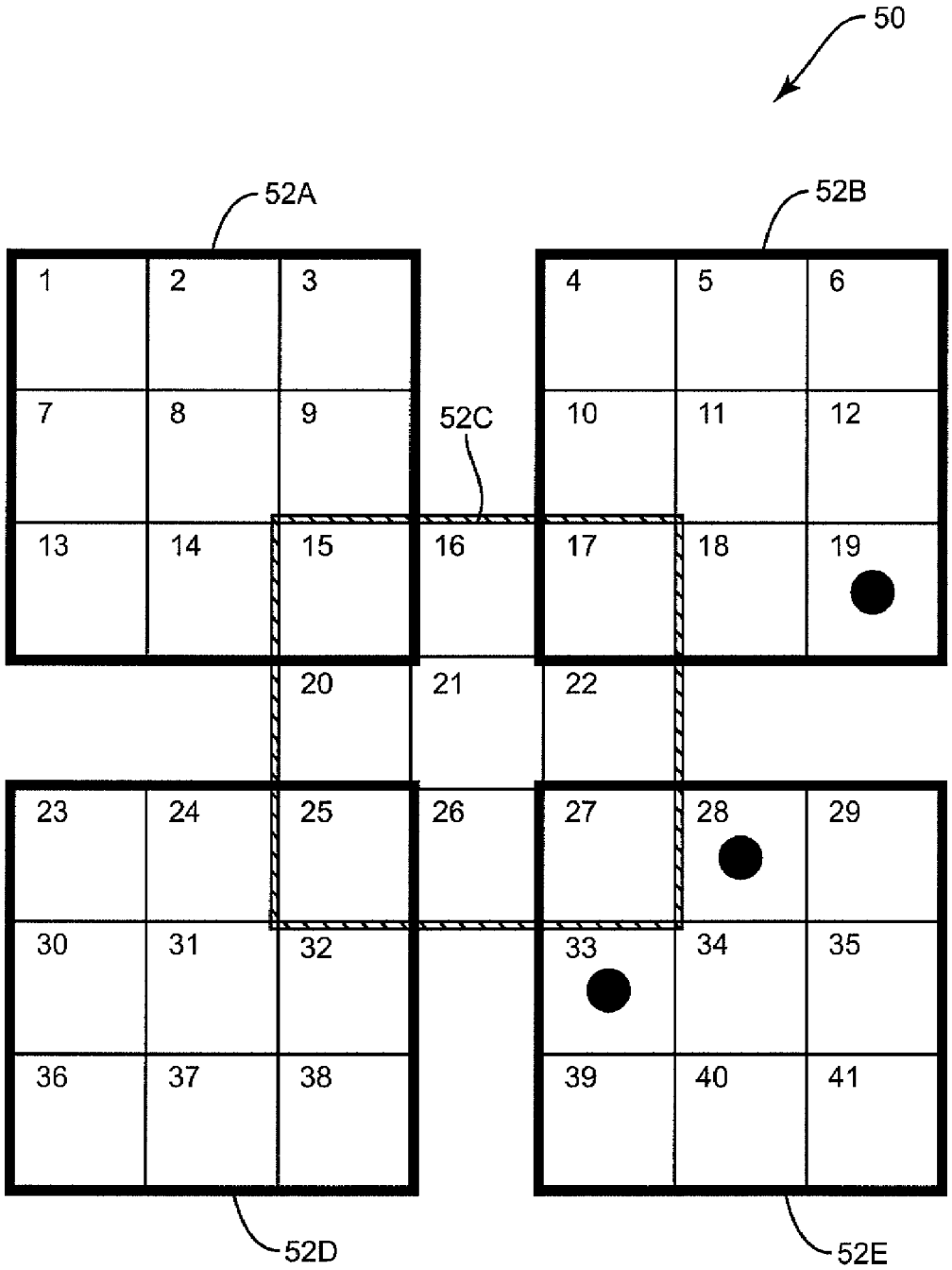
Figure 7:
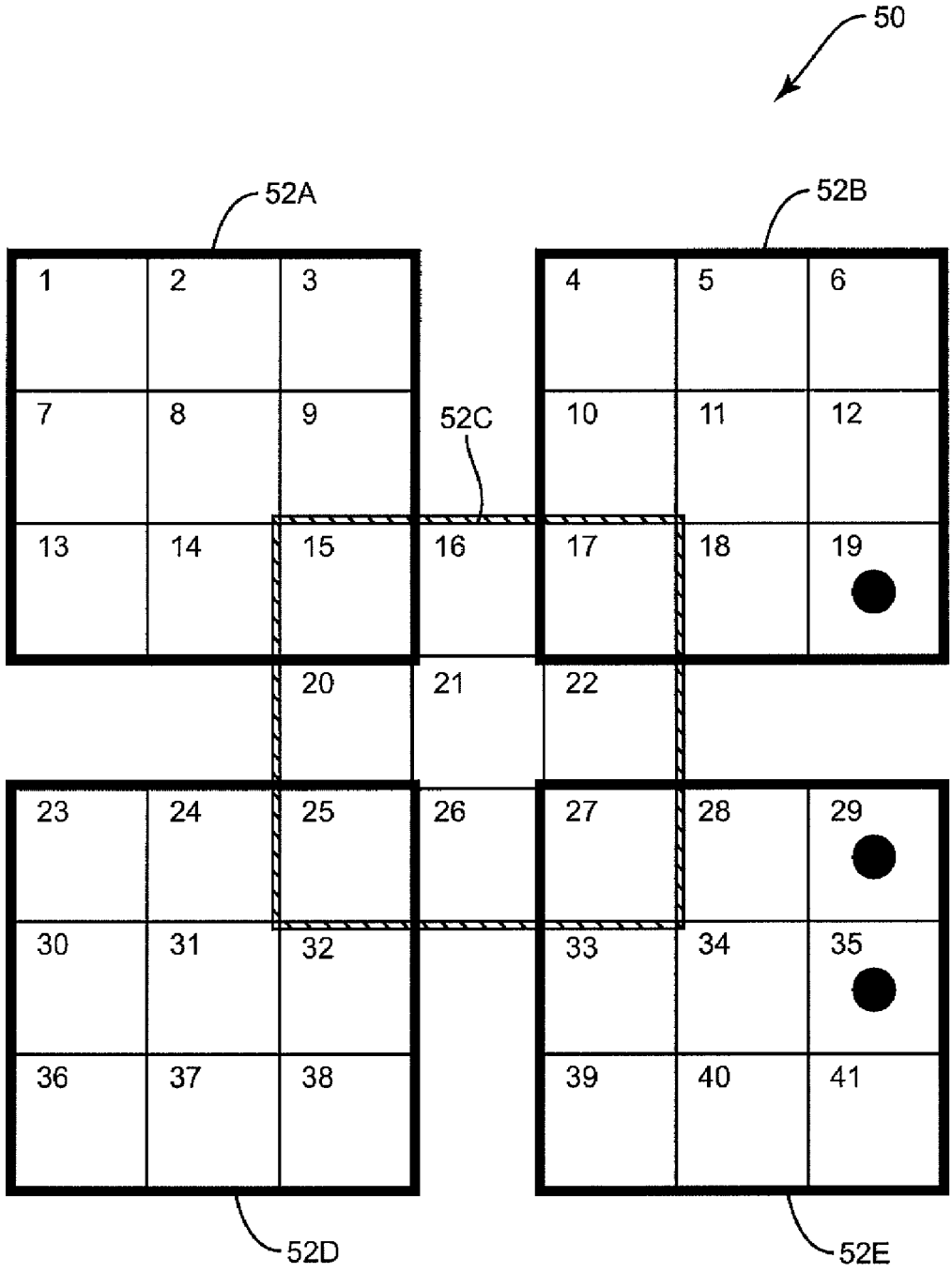

FIGS. 5-7 by contrast illustrate different examples of playing piece 56 placements that do not result in a tic-tac-toe. In FIG. 5, no tic-tac-toe is formed from a player having placed three playing pieces 56 in playing areas 2, 3, and 4. Although the playing areas 2, 3, and 4 are horizontally aligned, the areas 3 and 4 are not adjacent to one another because grids 52A and 52B are spaced apart. In FIG. 6, no tic-tac-toe is formed from a player having placed three playing pieces 56 in playing areas 19, 28, and 33. The playing areas 19, 28, and 33 are not aligned, and the areas 19 and 28 are not adjacent to one another. Finally, in FIG. 7, no tic-tac-toe is formed from a player having placed three playing pieces 56 in playing areas 19, 29, and 35. Although the playing areas 19, 29, and 35 are vertically aligned, the areas 19 and 29 are not adjacent to one another.

Notably, according to some embodiments, a game between players does not necessarily end when one player forms a tic-tac-toe. Instead, the game awards points to respective players for tic-tac-toes formed, and accumulates each player's points over one or more tic-tac-toes. The winner of the game is the player with the most points accumulated, e.g., when playing pieces 56 have been placed on all of the playing areas 54.

Figure 8:
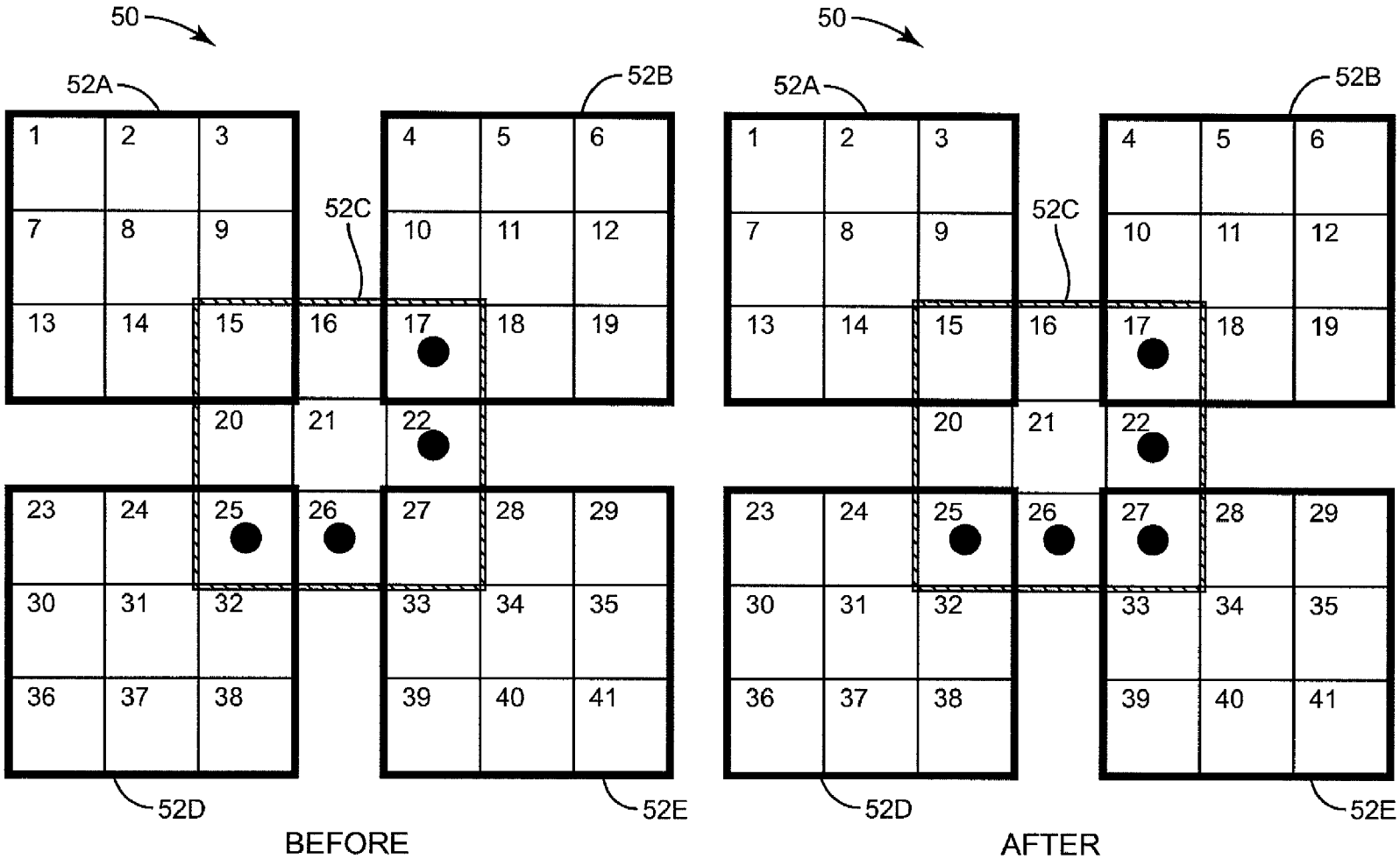
FIGS. 8-11 illustrate different examples of a player forming multiple tic-tac-toes with a single turn.

In one or more embodiments, a player receives a point for each tic-tac-toe that he or she forms. Accordingly, a player may in some cases receive multiple points during any one turn, if that player forms multiple tic-tac-toes with that turn. FIGS. 8-11 illustrate different examples of this, by illustrating snapshots of the playing areas 56 before and after a player's turn. In FIG. 8, a player receives two points for having formed two tic-tac-toes during a single turn. With that turn, the player placed a playing piece 56 in playing area 27. This placement formed one tic-tac-toe from three adjacent playing areas 25, 26, and 27 that are horizontally aligned in a row, and another tic-tac-toe from three adjacent playing areas 17, 22, and 27 that are vertically aligned in a column.

Figure 9:
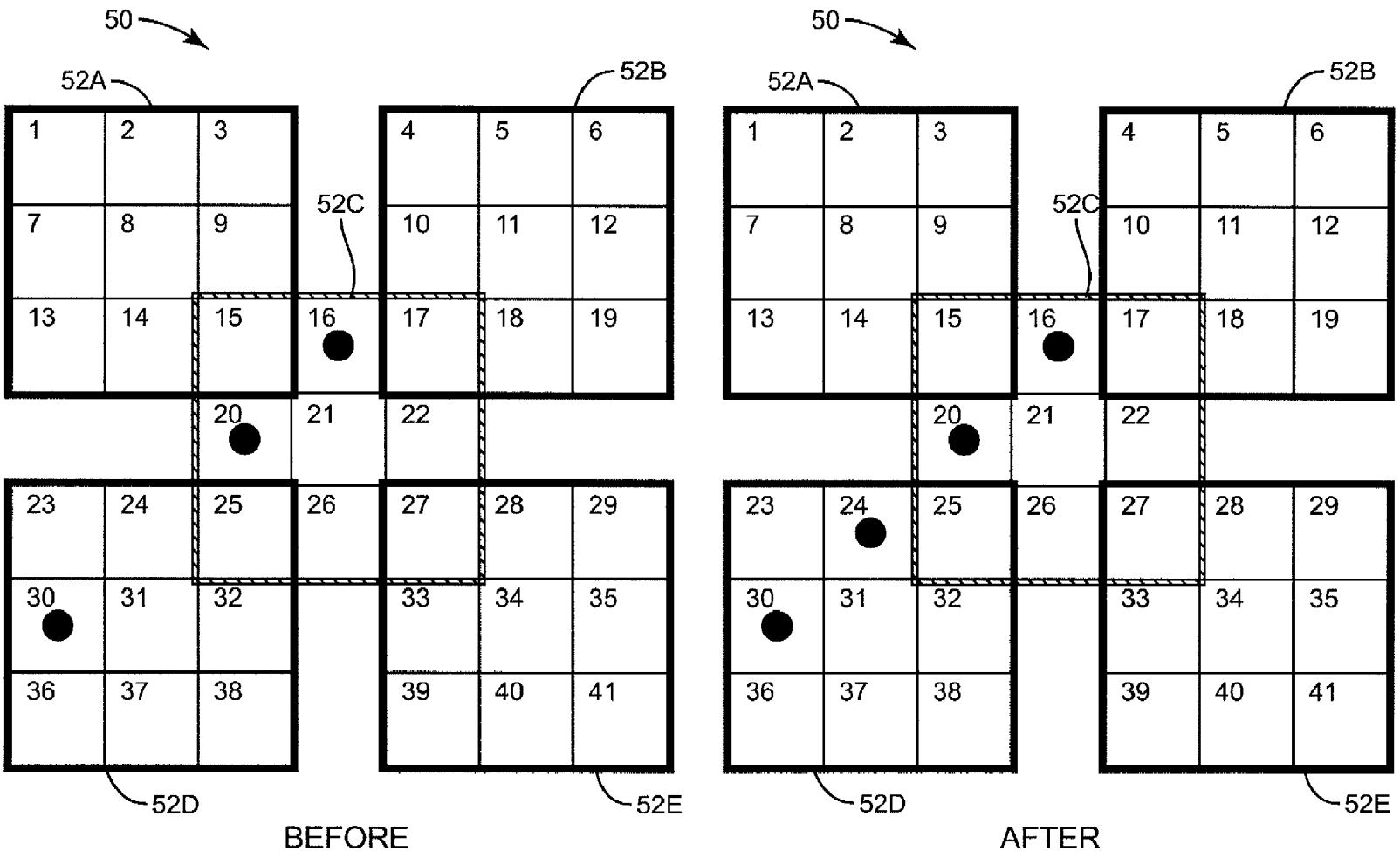
Figure 10:
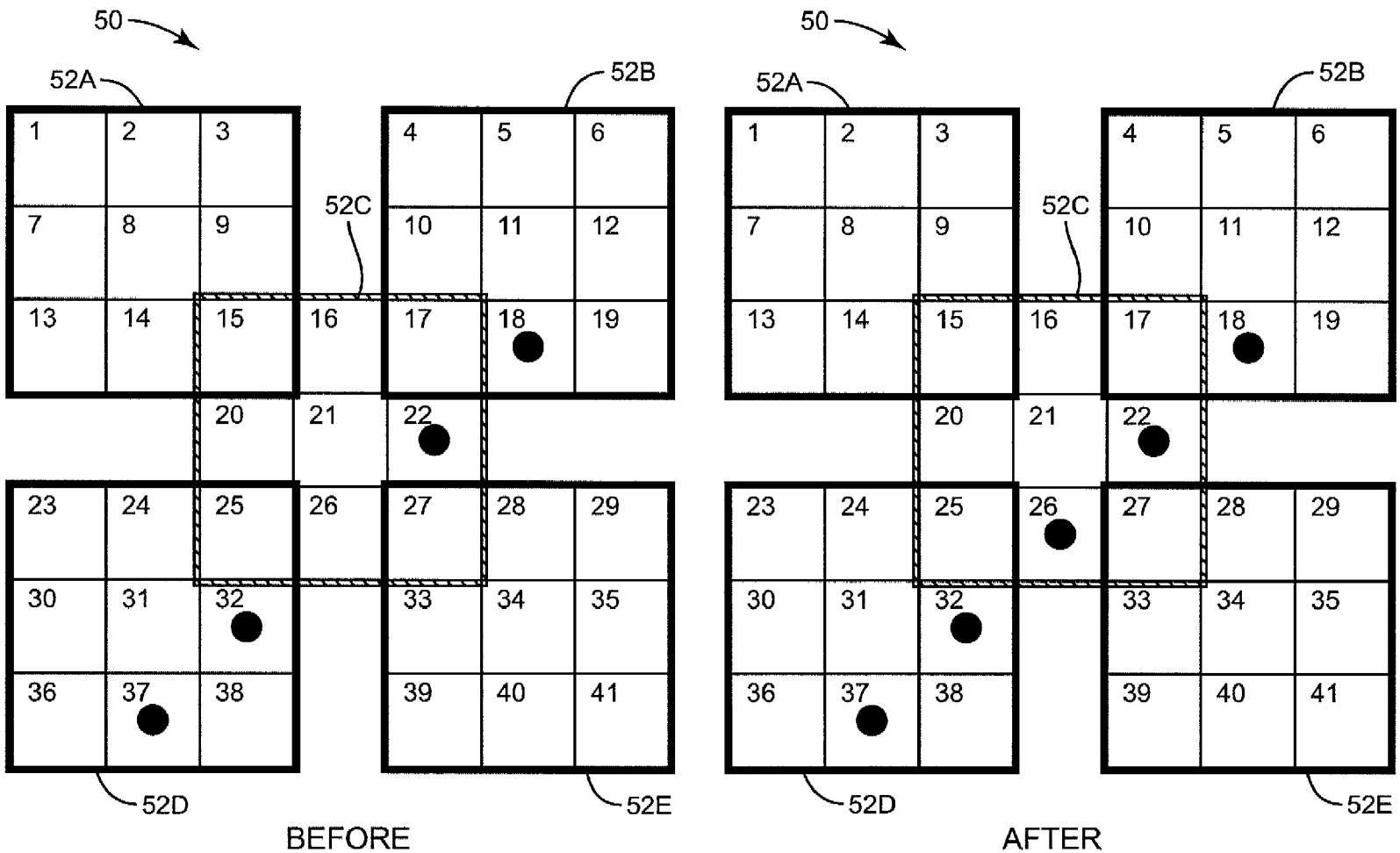

Similarly, in FIG. 9, a player receives two points for having formed two tic-tac-toes during a single turn. With that turn, the player placed a playing piece 56 in playing area 24. This placement formed one tic-tac-toe from three adjacent playing areas 20, 24, and 30 that are diagonally aligned, and another tic-tac-toe from three adjacent playing areas 16, 20, and 24 that are diagonally aligned. In this regard, a player may receive two points with any single turn by forming two rows, two columns, or two diagonals, or any combination of a row, a column, and a diagonal. Likewise, in FIG. 10, a player receives three points for having formed three tic-tac-toes by placing a playing piece 56 in playing area 26.

Figure 11:
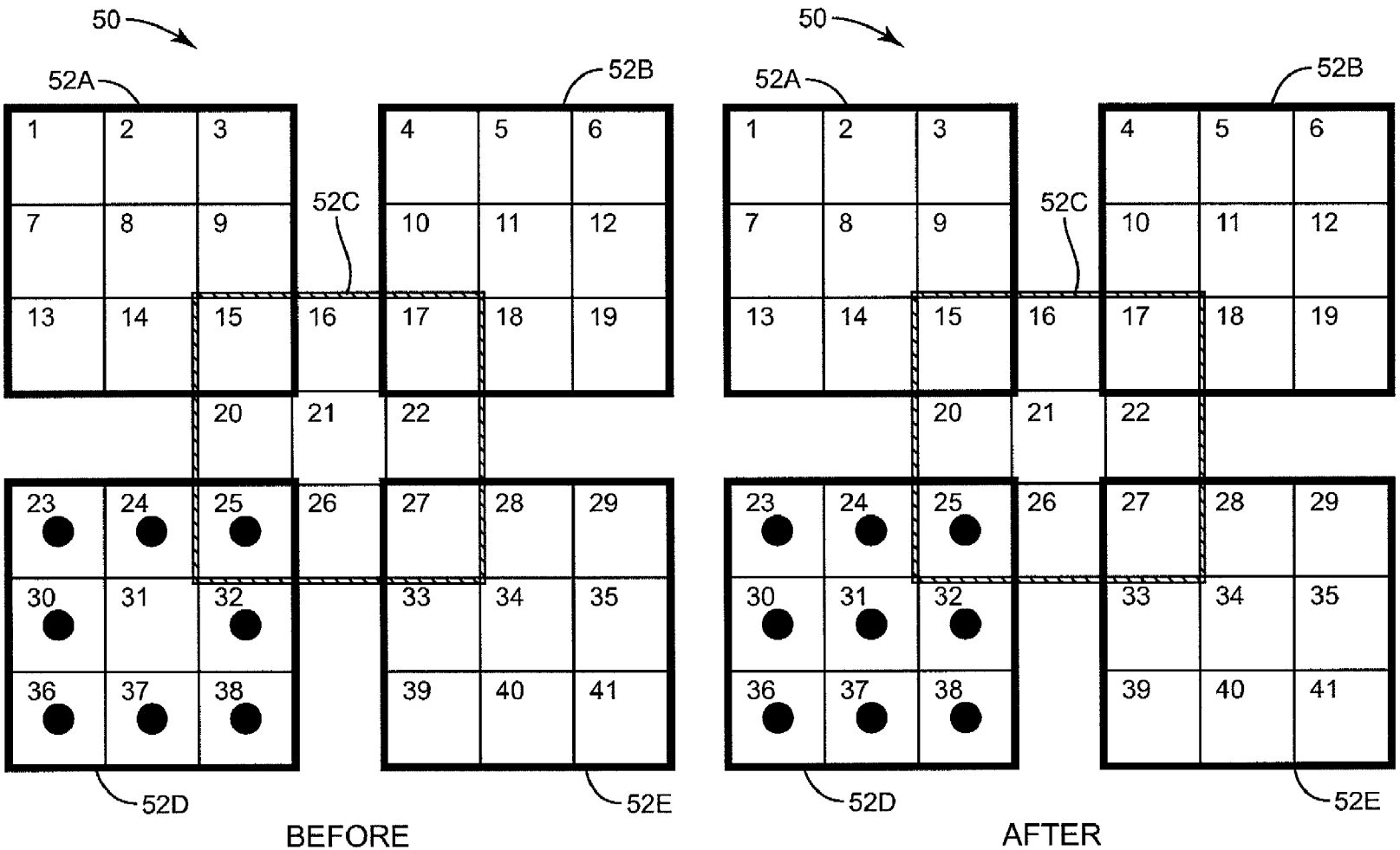

In FIG. 11, a player receives four points for having formed four tic-tac-toes during a single turn. With that turn, the player placed a playing piece 56 in playing area 31. This placement formed one tic-tac-toe from three adjacent playing areas 23, 31, and 38 that are diagonally aligned, one tic-tac-toe from three adjacent playing areas 25, 31, and 36 that are diagonally aligned, one tic-tac-toe from three adjacent playing areas 24, 31, and 37 that are vertically aligned, and one tic-tac-toe from three adjacent playing areas 30, 31, and 32 that are horizontally aligned.

In some embodiments, a player may also receive two points for each so-called "super tic-tac-toe" that he or she forms, compared to just one point for the "normal" tic-tac-toe just described. A player forms a super tic-tac-toe as used herein if he or she places a predetermined number of playing pieces 56 in a corresponding number of non-adjacent playing areas 54 that are aligned, but belong to different individual tic-tac-toe grids 52. In some embodiments, for example, a player forms a super tic-tac-toe if he or she places one playing piece 56 in a center playing area 54 of the central tic-tac-toe grid 52, and two playing pieces 56 in two aligned, corner playing areas 54 that are disposed farthest from the center playing area 54.

Figure 12B:
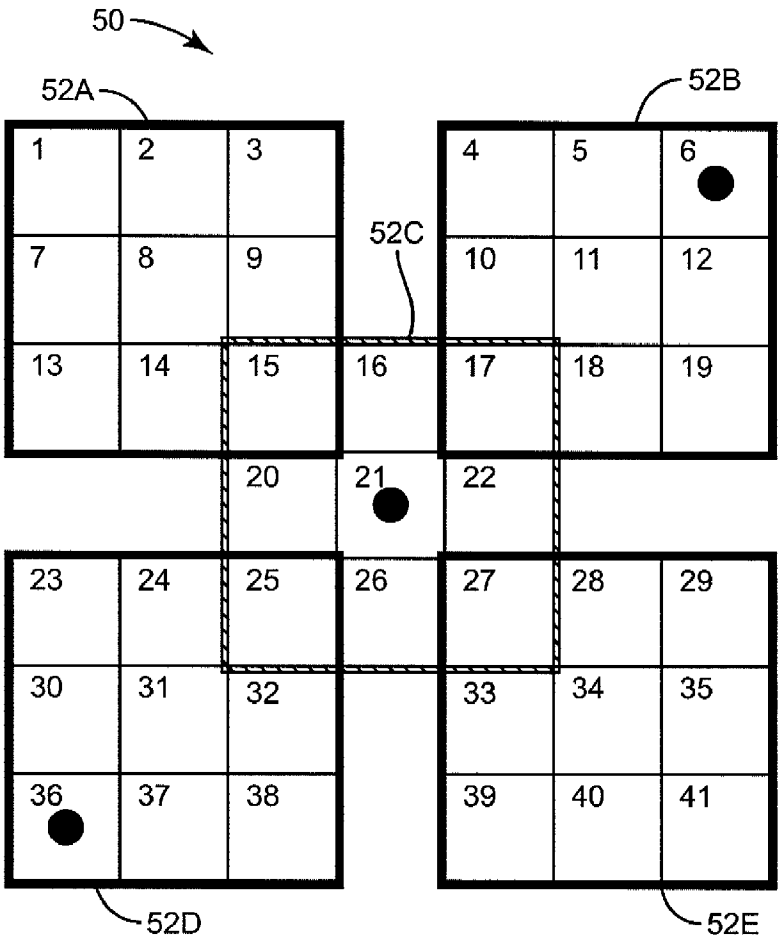
FIGS. 12A, 12B, and 13 illustrate different examples of playing piece placements that result in a super tic-tac-toe, according to some embodiments.
Figure 12A:
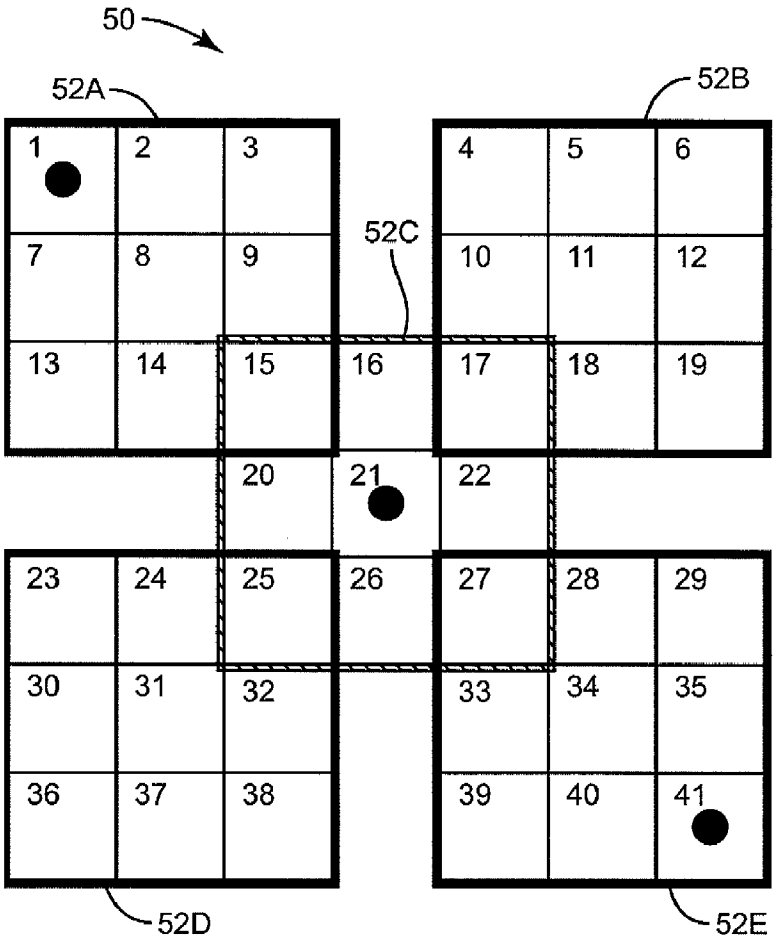

FIGS. 12A and 12B illustrate different example of super tic-tac-toes consistent with the above. FIG. 12A shows a super tic-tac-toe formed from a player having placed three playing pieces 56 in three non-adjacent playing areas 1, 21, and 41 that are diagonally aligned, but belong to different individual tic-tac-toe grids 52A, 52C, and 52E, respectively. Moreover, in accordance with the example above, one playing piece 56 has been placed in the center playing area 21 of the central tic-tac-toe grid 52C, and two playing pieces 56 have been placed in two aligned, corner playing areas 1 and 41 that are disposed farthest from that center playing area 21. FIG. 12B shows a different super tic-tac-toe formed from two other aligned, corner playing areas 6 and 36 that are disposed farthest from the center playing area 21. At least in the embodiment shown, these are the only super tic-tac-toes possible in a single game.

Figure 13:
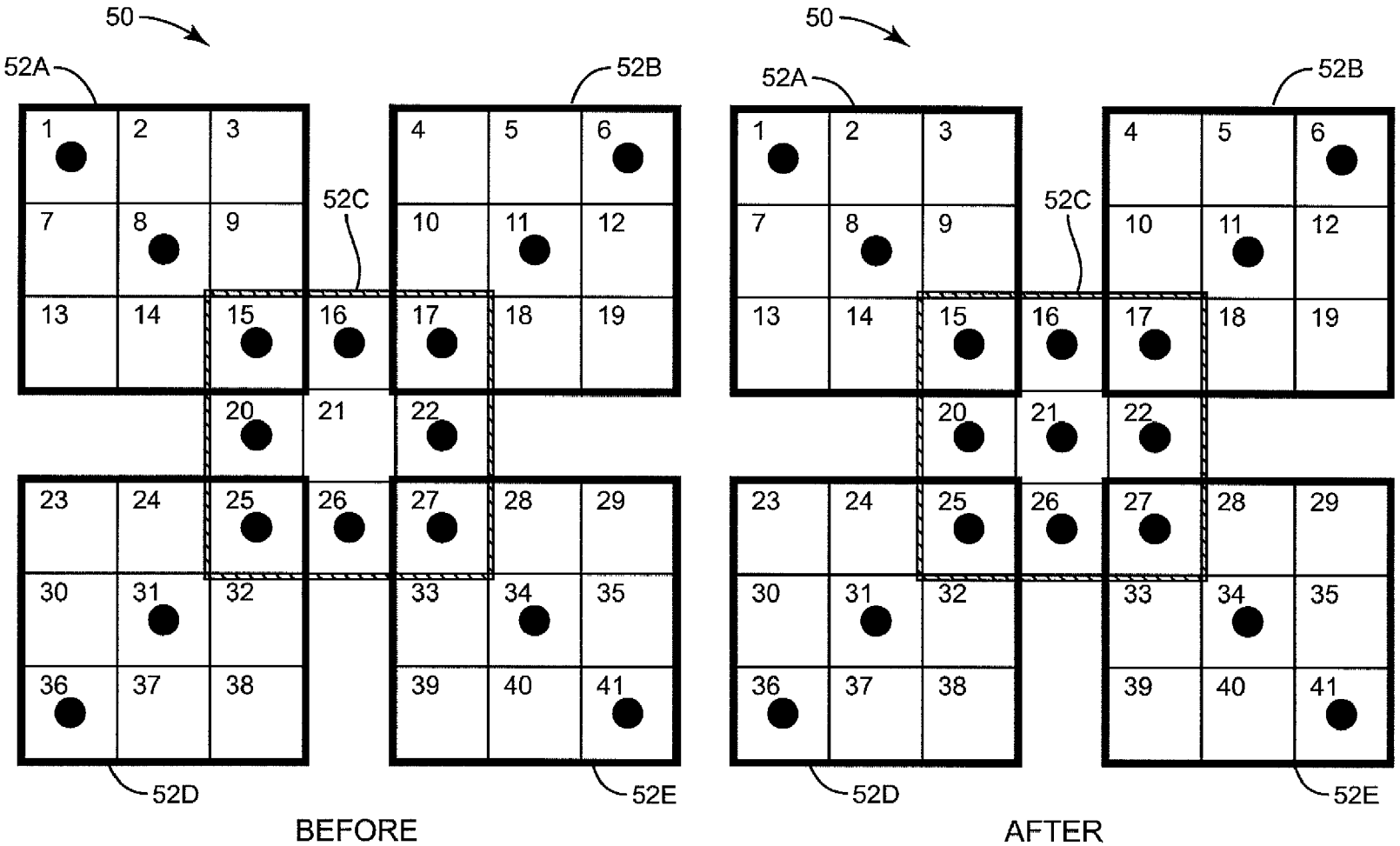

FIG. 13 combines many of the examples just discussed in order to illustrate how a player can form multiple tic-tac-toes as well as multiple super tic-tac-toes during a single turn. In FIG. 13, a player receives twelve points for having formed eight tic-tac-toes and two super tic-tac-toes during a single turn. With that turn, the player formed six diagonal tic-tac-toes (8-15-21, 15-21-27, 21-7-33, 31-25-21, 25-21-17, and 21-17-11), one vertical tic-tac-toe (16-21-26), one horizontal tic-tac-toe (20-21-22), and two super tic-tac-toes (1-21-41 and 6-21-36). This is the maximum number of tic-tac-toes and super tic-tac-toes that a player can form with any one turn, at least in this embodiment.

Figure 14:
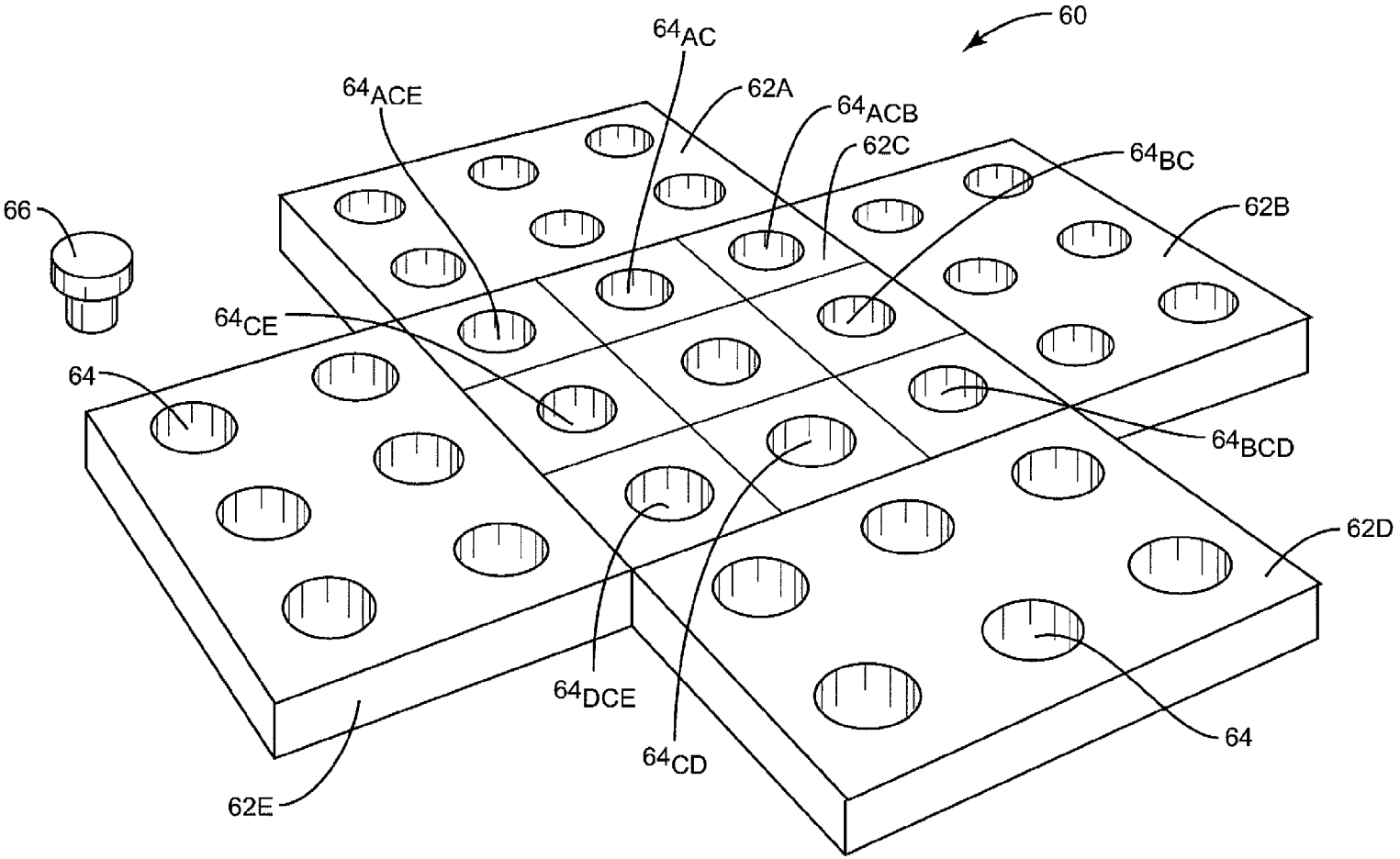
FIG. 14 shows an isometric view of a multi-grid tic-tac-toe game apparatus according to other embodiments.
Figure 15B:
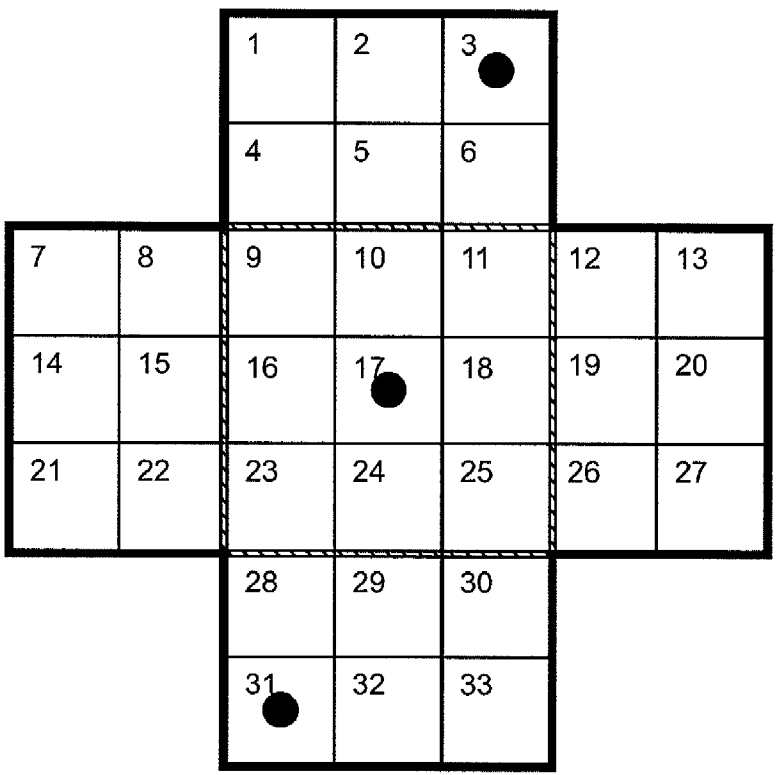
FIGS. 15A-15D illustrate different examples of playing piece placements that result in a super tic-tac-toe, according to other embodiments.
Figure 15A:
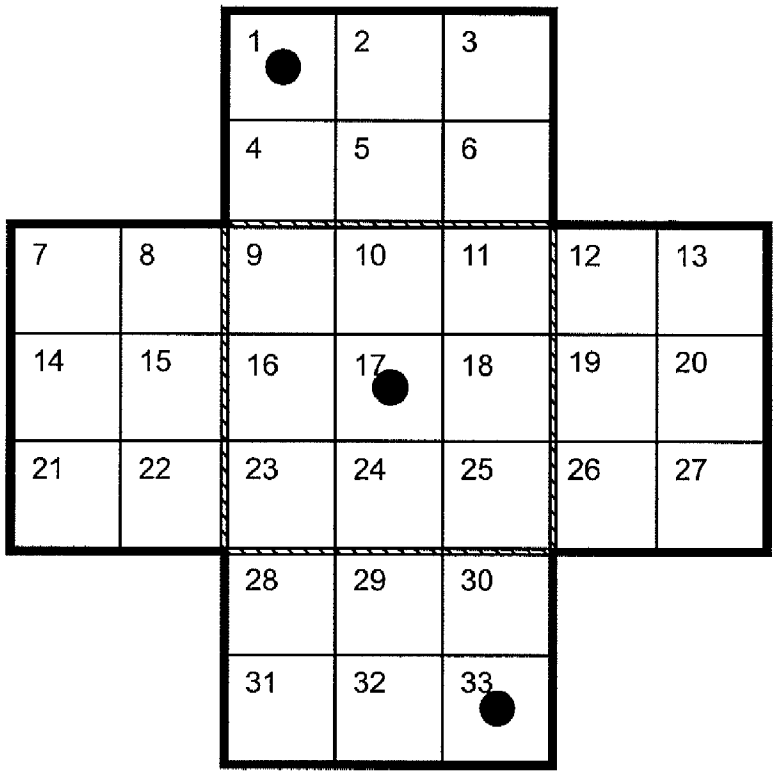
Figure 15D:
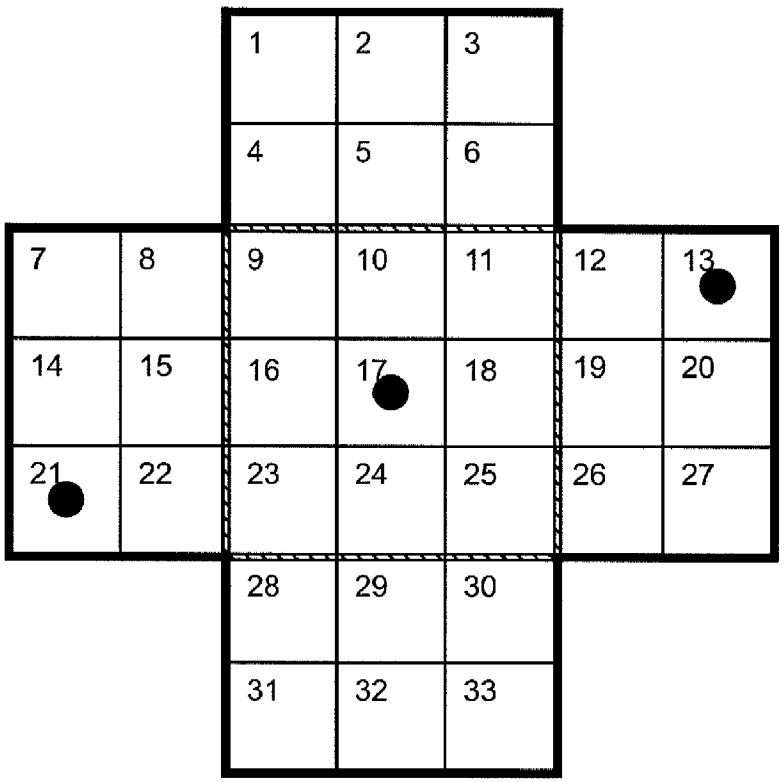
Figure 15C:
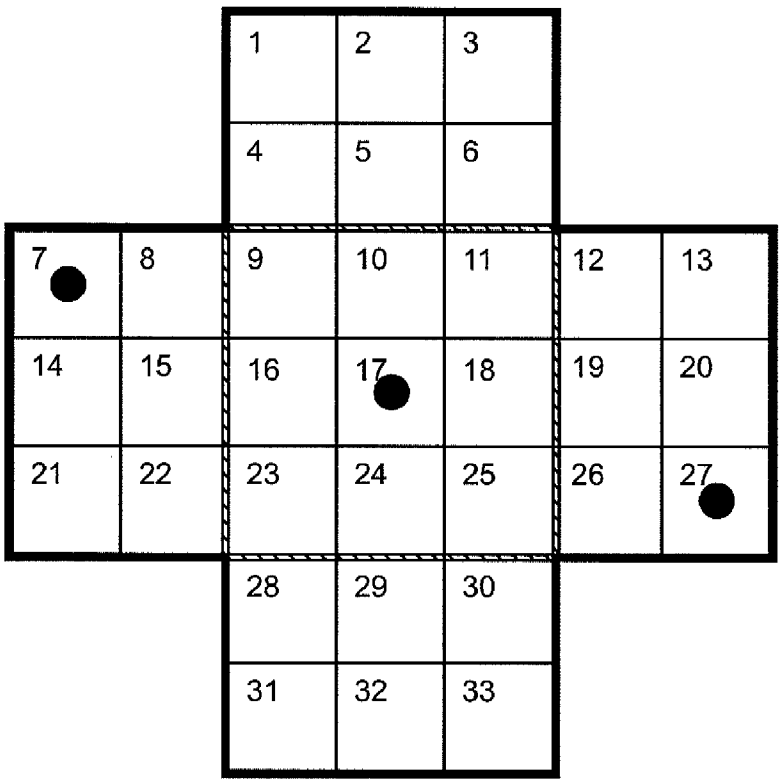

FIG. 14 illustrates a multi-grid tic-tac-toe game apparatus 60 according to one or more other embodiments. The game apparatus 60 is similar to the apparatus 50 of FIG. 1 in many respects. The game apparatus 60 comprises a plurality of individual tic-tac-toe grids 62A-62E, and each of the individual tic-tac-toe grids 62 includes a plurality of playing areas 64. Also, at least one of the individual tic-tac-toe grids 62 shares at least one common playing area 64 with another one of the individual tic-tac-toe grids 62.

Further, the individual tic-tac-toe grids 62 include a plurality of peripheral tic-tac-toe grids 62A, 62B, 62D, 62E as well as a central tic-tac-toe grid 62C. This central grid 62C is disposed in the center of the peripheral grids 62A, 62B, 62D, and 62E, and correspondingly shares at least one common playing area 64 with each peripheral grid. Moreover, the central grid 62C includes four outer corner playing areas that also constitute inner corner playing areas of the peripheral grids 62A, 62B, 62D, and 62E.

Still further, the grids 62 comprise four diagonal lines of playing areas 64. Each of these diagonal lines includes three aligned playing areas 64 that span two of the peripheral grids and the central grid. The grids 62 also comprise six parallel lines of playing areas 64. Each of these parallel lines includes seven aligned playing areas 64 that span two of the peripheral grids and the central grid.

However, as compared to the game apparatus 50 of FIG. 1, the game apparatus 60 of FIG. 14 includes more extensive sharing of common playing areas 64. In fact, common playing areas 64 in the game apparatus 60 of FIG. 14 may be shared not only between the central grid 62C and a peripheral grid 62, but also between different peripheral grids 62. As shown in FIG. 14, any two peripheral grids 62 share at most one common playing area 64 with each other.

The central tic-tac-toe grid 62C in FIG. 14 also shares a greater number of common playing areas 64 with any given peripheral grid 62. Specifically, each individual tic-tac-toe grid 62 includes three rows of three playing areas 64 each. Any given peripheral grid 62 shares an entire row (i.e., three common playing areas 64) with the central grid 62C.

Thus, as shown in FIG. 14, peripheral grid 62A shares three common playing areas $\mathbf{64}_{ACE}$, $\mathbf{64}_{AC}$, and $\mathbf{64}_{ACB}$ with central grid 62C. Of those, peripheral grid 62A shares common playing area $\mathbf{64}_{ACE}$ also with peripheral grid 62E, and shares common playing area $\mathbf{64}_{ACB}$ also with peripheral grid 62B. The same can be said of the remaining common playing areas $\mathbf{64}_{BC}$, $\mathbf{64}_{BCD}$, $\mathbf{64}_{CD}$, $\mathbf{64}_{DCE}$, and $\mathbf{64}_{CE}$, where subscripts indicate the grids that share the respective playing area.

Accordingly, the individual tic-tac-toe grids 62 in FIG. 14 collectively include thirty-three playing areas 64. Eight of those playing areas 64 are common playing areas 64. Each common playing area 64 is shared between two or more individual tic-tac-toe grids 62.

Play using the game apparatus 60 of FIG. 14 proceeds very similarly to that already discussed with respect to the game apparatus 50 of FIG. 1. FIGS. 15A-15D, however, illustrate one notable difference with respect to super tic-tac-toes. Specifically, four super tic-tac-toes are possible in a single game with this arrangement, instead of just two.

Those skilled in the art will of course appreciate that the embodiments shown in the above figures represent non-limiting examples, and that numerous variations may be made without departing from the spirit and scope of the invention. For example, the particular number of playing areas, and their particular arrangement, may differ from that discussed above. Also, the particular number of points awarded for a tic-tac-toe, or super tic-tac-toe, may be customized in any manner. Further, the particular shape, size, and color of the individual playing pieces may be modified in any number of ways to distinguish different sets of playing pieces for different players (or teams).

Those skilled in the art will also appreciate that the game apparatus 50, 60 described above may be embodied as a physical, two-dimensional game board, or portion thereof. In this case, the individual tic-tac-toe grids 52, 62 and their respective playing areas 64 lie along a single playing surface. Also, the apparatus 50, 60 may be incorporated into a substrate or other game board structure that is round, square, or any other shape. This game board structure may be constructed of various suitable materials such as plastic, wood, metal or, any combination thereof.

The game board may further include a mechanism integral therewith for recording or otherwise tracking player points. For example, the game board may include two or more sets of receptacles (not shown), one for each player. In this case, the receptacles of any given set are configured to receive scoring pieces (e.g., pegs) of a particular player, for conveniently tracking the number of points awarded to that player.

Figure 16:
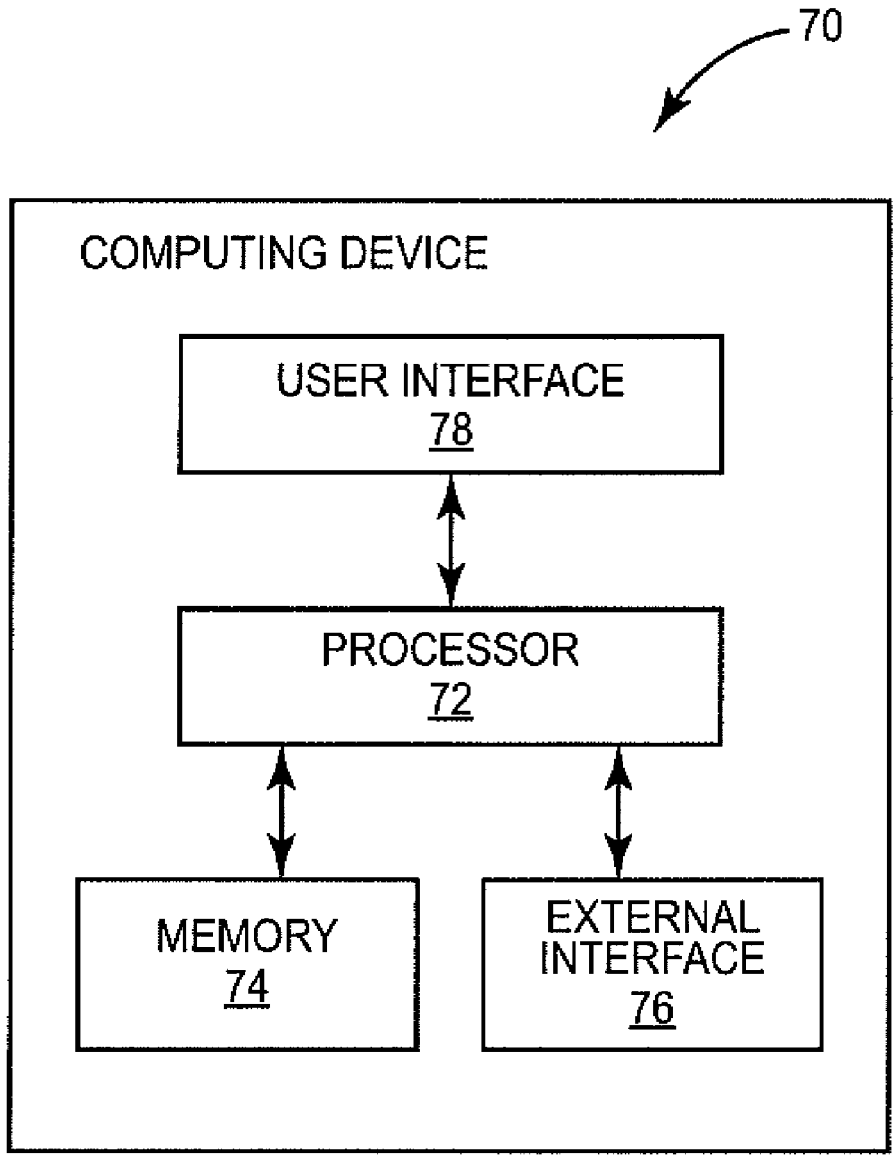
FIG. 16 is a block diagram of a computing device configured to execute computer program code of a computer program product, according to one or more embodiments.

The multi-grid tic-tac-toe game apparatus may alternatively be embodied in a computer program product. Such a computer program product as taught herein is stored on a computer readable medium, such as a hard disk, an optical disk (e.g., a CD-ROM or DVD disk), a flash memory stick, or the like. So stored, the computer program product includes computer program code that may be executed by a processor associated with a computing device. FIG. 16 illustrates one embodiment of such a computing device, which may be a desktop computer, a laptop computer, a portable digital assistant (PDA), a mobile phone, or the like.

In FIG. 16, a computing device 70 includes a processor 72, memory 74 and/or external interface 76, and a user interface 78. The computer program product may be stored on memory 74 or some other medium readable by the processor 72 via external interface 76. When the computer program code is accessed and executed by the processor 72, the code causes the device 70 to implement a tic-tac-toe game between at least two players. One of these players may be a remote player that plays against the user of the device 10 via a remote communications interface (not shown).

In another embodiment, one of the players is a computerized opponent configured to play against the user of the device 10, in accordance with the computer program code. For example, after each move by the user, the computerized opponent can consider numerous variables such as: the user's last move, opportunities to block the user from forming tic-tac-toes, opportunities for the computerized opponent to form tic-tac-toes, time into the game (beginning stages, intermediate stages, final stages), the general state of the multi-grid board, and the potential future opportunities of the user and the computer for forming tic-tac-toes. In this regard, the code may cause the device 70 to analyze these variables and to make an intelligent move, in the context of a selected difficulty level.

Figure 17:
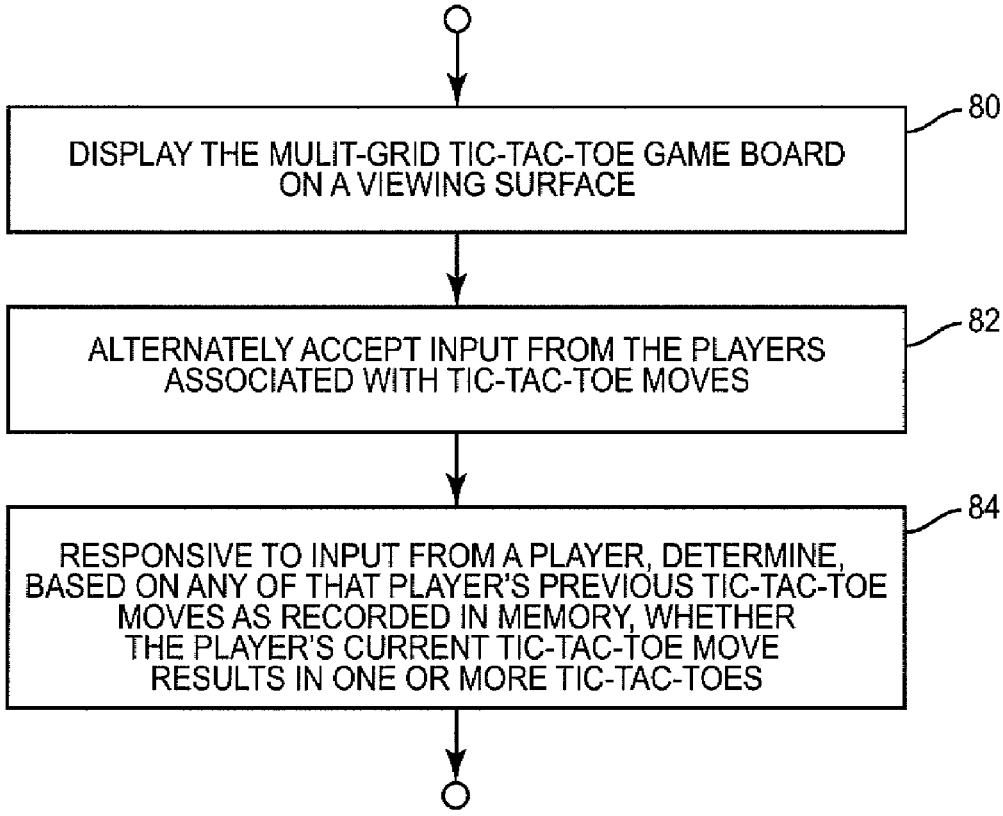
FIG. 17 is a logic flow diagram of processing performed in accordance with the computer program product of FIG. 16.
Figure 18:
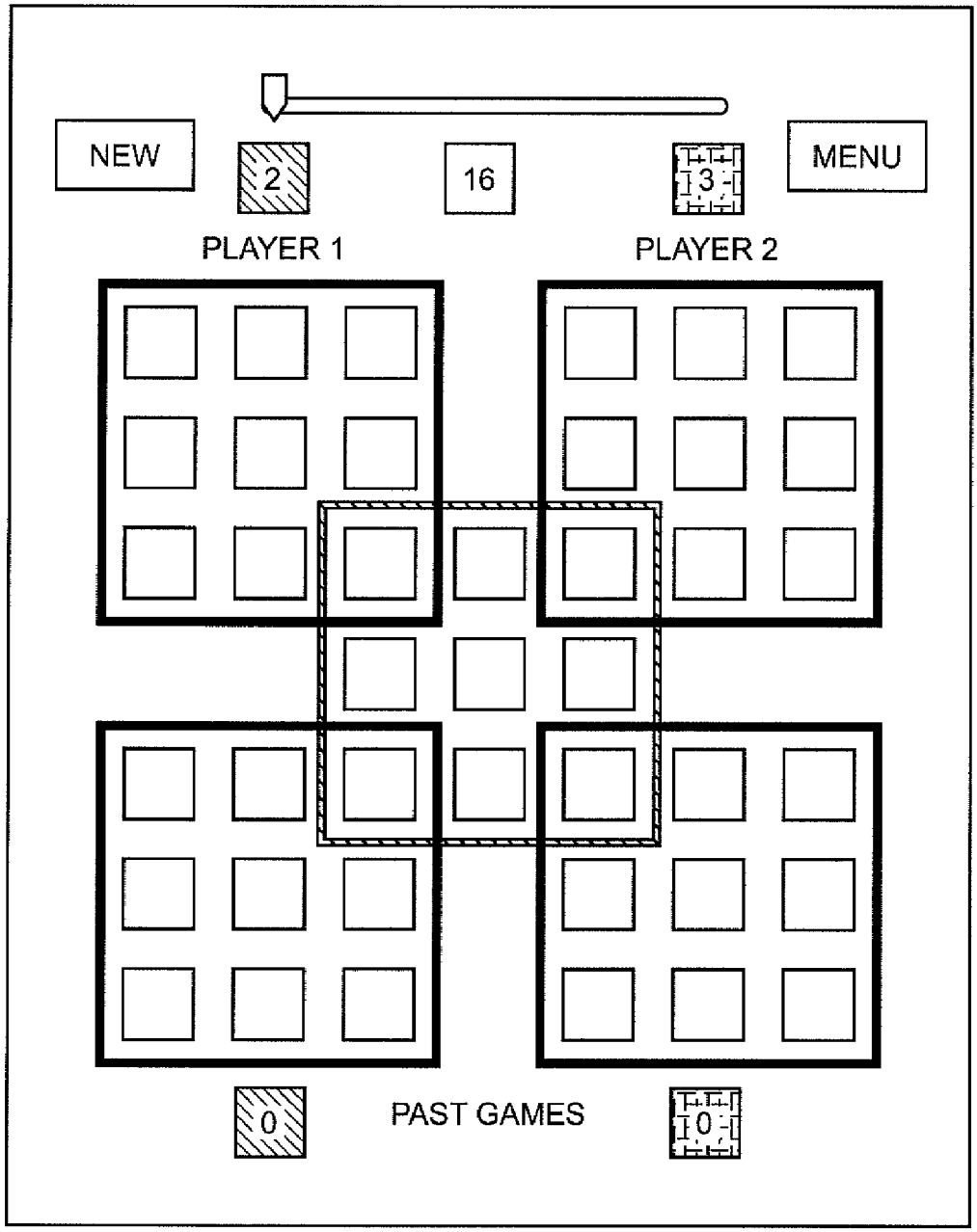
FIGS. 18-21 illustrate different examples of playing piece placements associated with a tic-tac-toe game implemented by the computer program product of FIG. 16.

Regardless, the code causes the device 70 to perform the processing illustrated in FIG. 17. As shown in FIG. 17, the code causes the device 70 to display a multi-grid tic-tac-toe game board on a viewing surface associated with the user interface 78 (Block 80). See, for example, FIG. 18. The multi-grid tic-tac-toe game board, consistent with the above description of FIGS. 1 and 14, comprises a plurality of individual tic-tac-toe grids. Each of the individual tic-tac-toe grids includes a plurality of playing areas. And, at least one of the individual tic-tac-toe grids shares at least one common playing area with another one of the individual tic-tac-toe grids.

The code also causes the device 10 to accept input from the players associated with tic-tac-toe moves (Block 82). The code may cause the device 10 to accept this input from user interface 78, or from a remote communications interface (not shown). If one of the players is a computerized opponent, the code may cause the device 10 to accept input associated with tic-tac-toe moves of that computerized opponent in accordance with a selected difficulty level. Regardless, the input associated with a player's tic-tac-toe move includes a selection of one of the playing areas, as discussed above. Finally, the code causes the device 10 to, responsive to input from a player, determine whether the player's current tic-tac-toe move results in one or more tic-tac-toes. This determination is based on any of that player's previous tic-tac-toe moves as recorded in memory (e.g., memory 74).

Figure 19A:
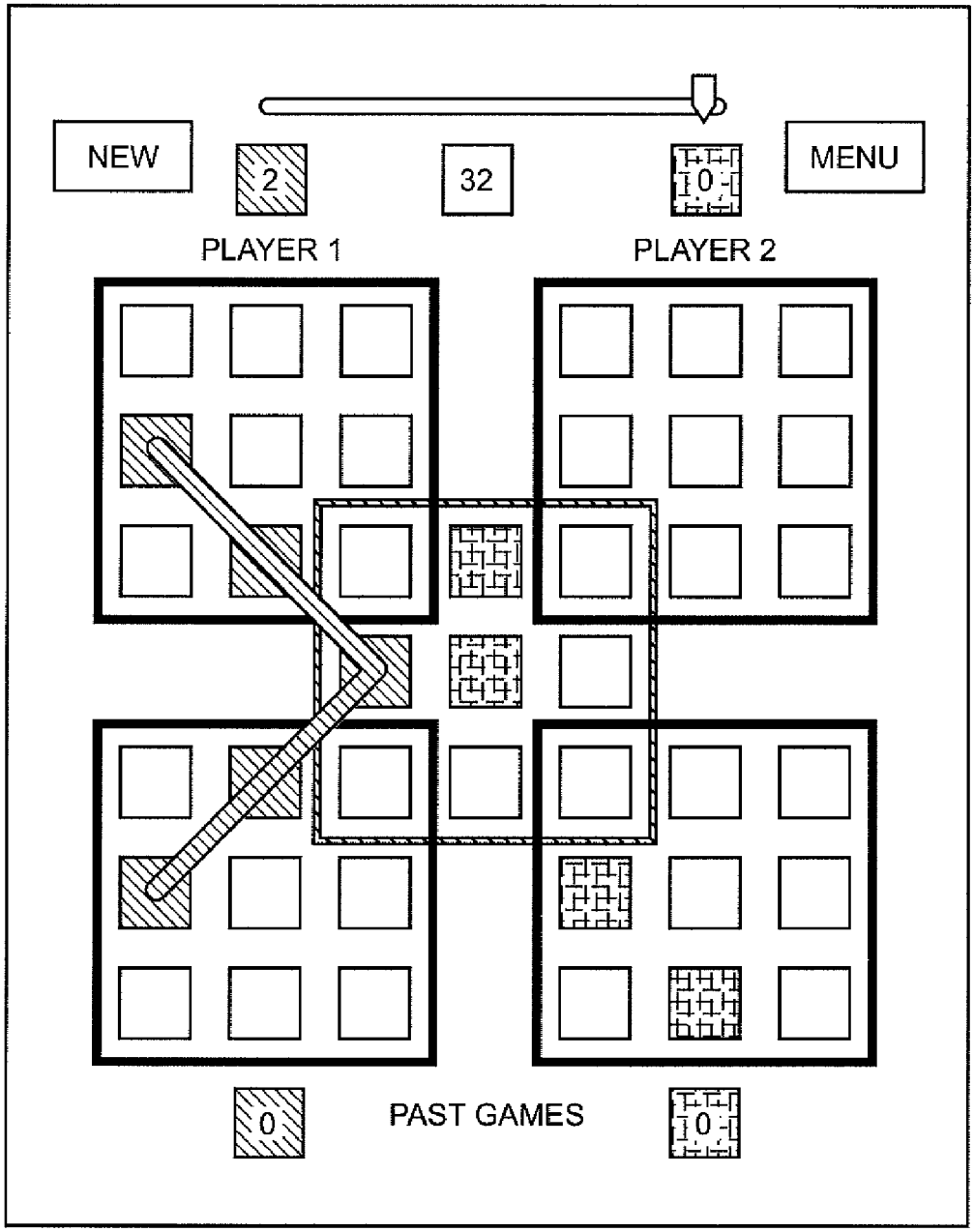
Figure 19B:
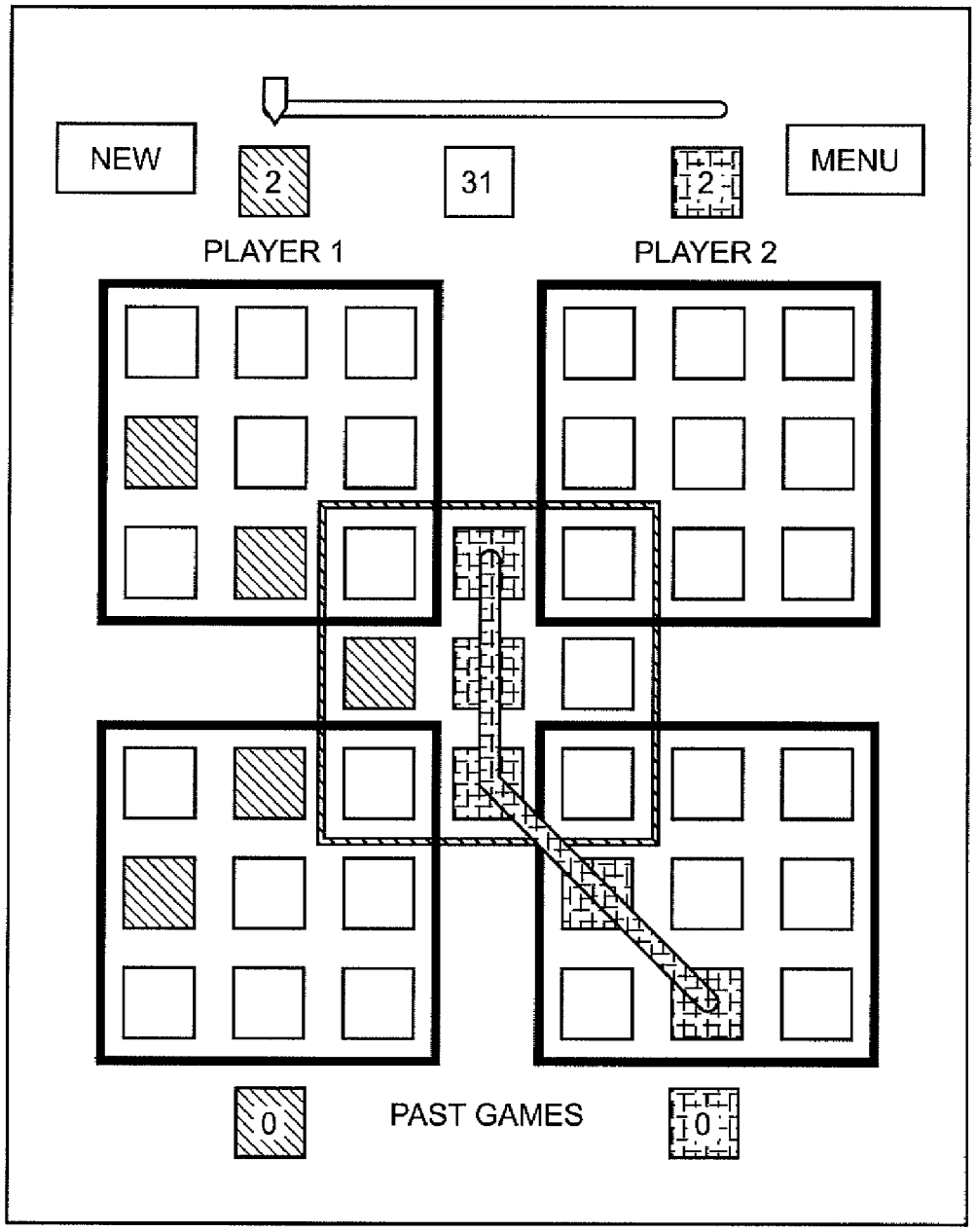

The code in various embodiments causes the device 70 to determine whether the player's current move results in one or more tic-tac-toes, in a manner consistent with the rules discussed above with respect to FIGS. 1 and 14. Specifically, the code causes the device 70 to determine that a player's move results in a tic-tac-toe if the player has selected a predetermined number of adjacent playing areas that are aligned, irrespective of whether those playing areas belong to different individual tic-tac-toe grids. See, for example, FIGS. 19A-19B, which illustrate tic-tac-toes that extend across different individual tic-tac-toe boards.

Figure 20:
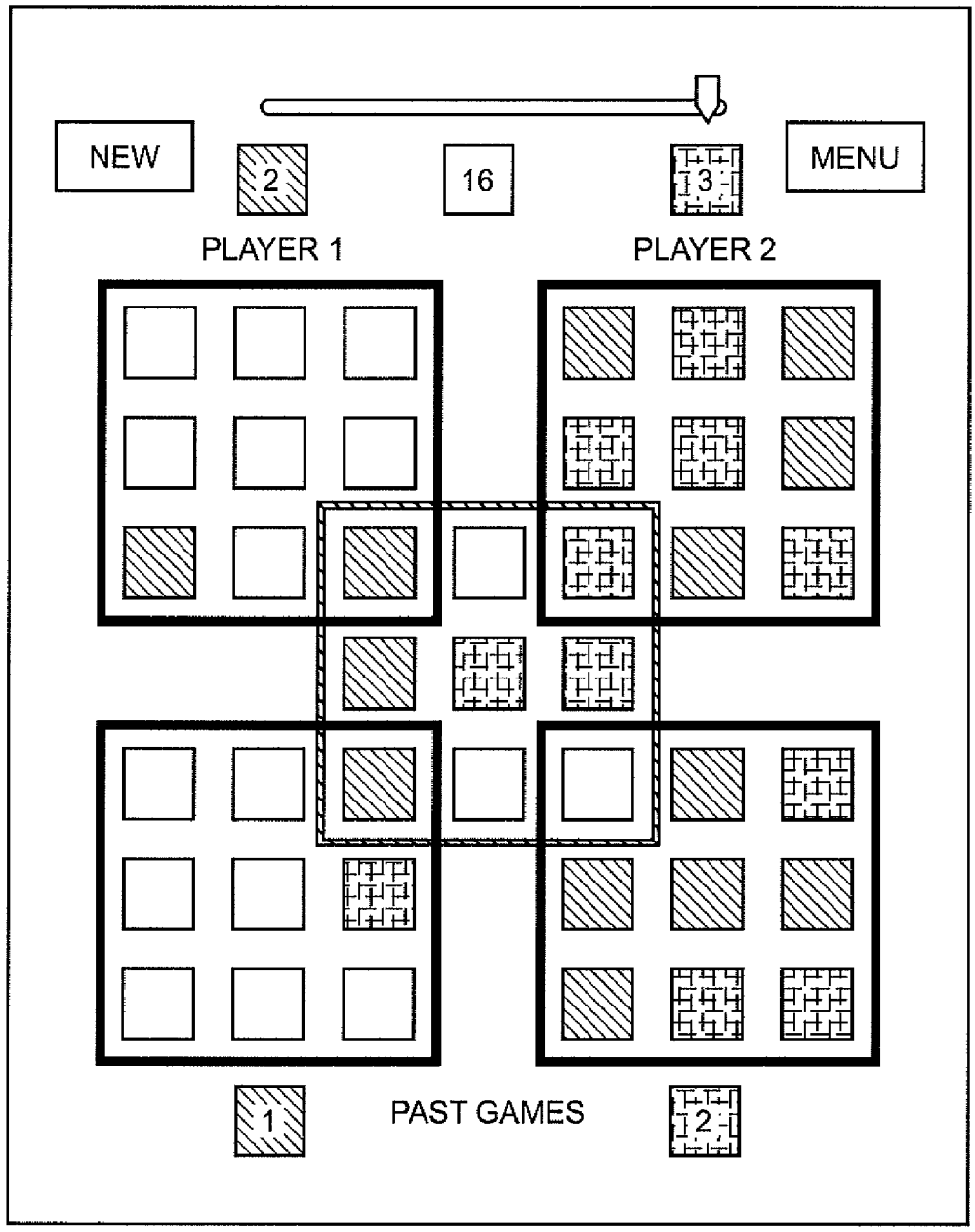

In this regard, the code in some embodiments causes the device 70 to award points to respective players for tic-tac-toes formed, and to accumulate each player's points over one or more tic-tac-toes. The code then causes the device 70 to determine the winner of the tic-tac-toe game as the player with the most points accumulated. Thus, the device 70 does not immediately declare the winner of the tic-tac-toe game and clear all playing area selections as soon as one player forms a tic-tac-toe. Instead, the code causes the device 70 to maintain the playing area selections, even after one player forms a tic-tac-toe, and to defer declaration of the winner until all or substantially all playing areas have been selected. See, for example, FIG. 20, which shows that playing area selections are maintained even after one player forms a tic-tac-toe.

Figure 21:
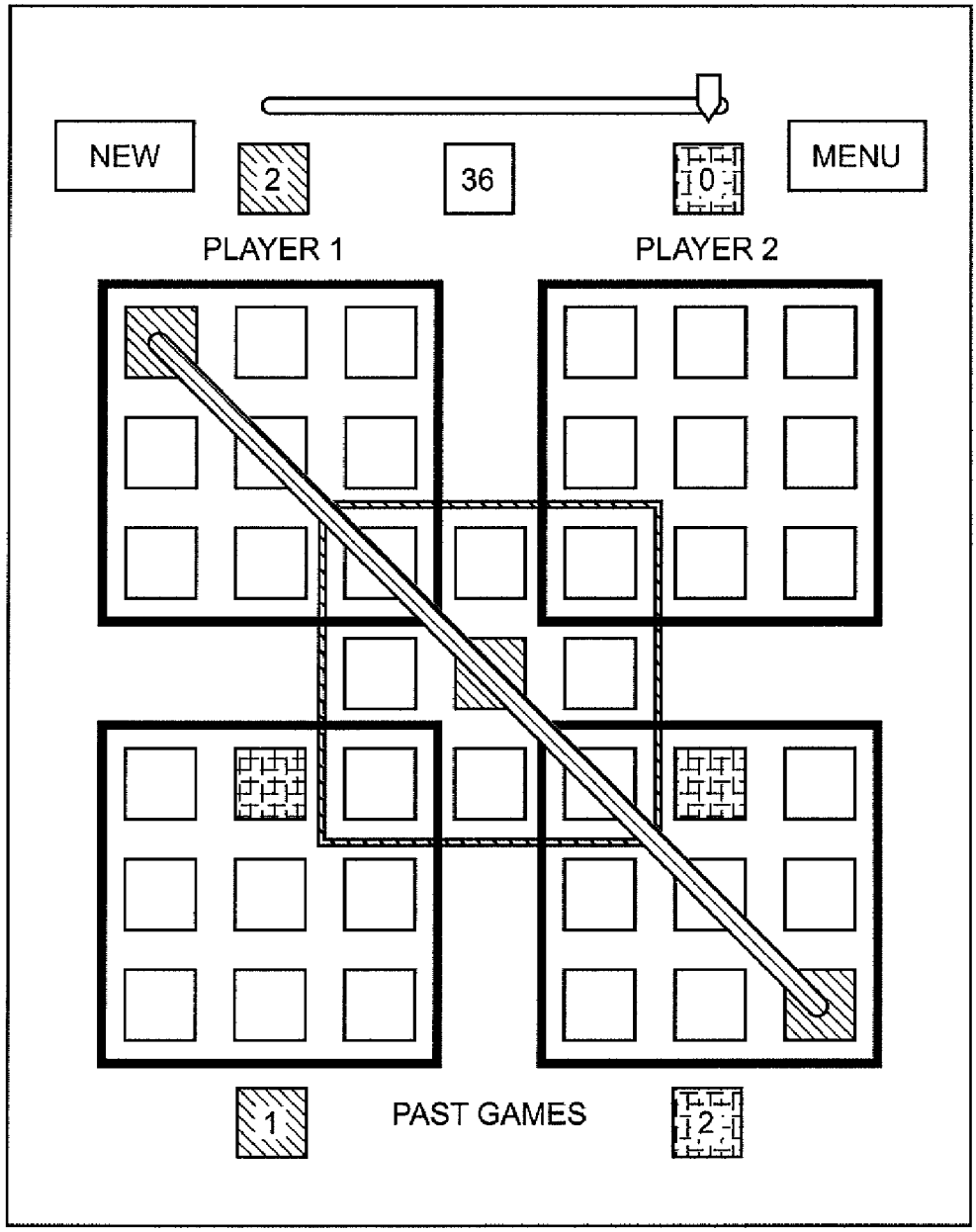

In one or more embodiments, the plurality of individual tic-tac-toe grids includes two or more peripheral tic-tac-toe grids, as well as a central tic-tac-toe grid disposed in the center of the peripheral tic-tac-toe grids. In these embodiments, the code causes the device 70 to award a different number of points for normal tic-tac-toes and super tic-tac-toes, as described above. See, for example, FIG. 21, which shows that the device 70 awards two points for a super tic-tac-toe.

Figure 22:
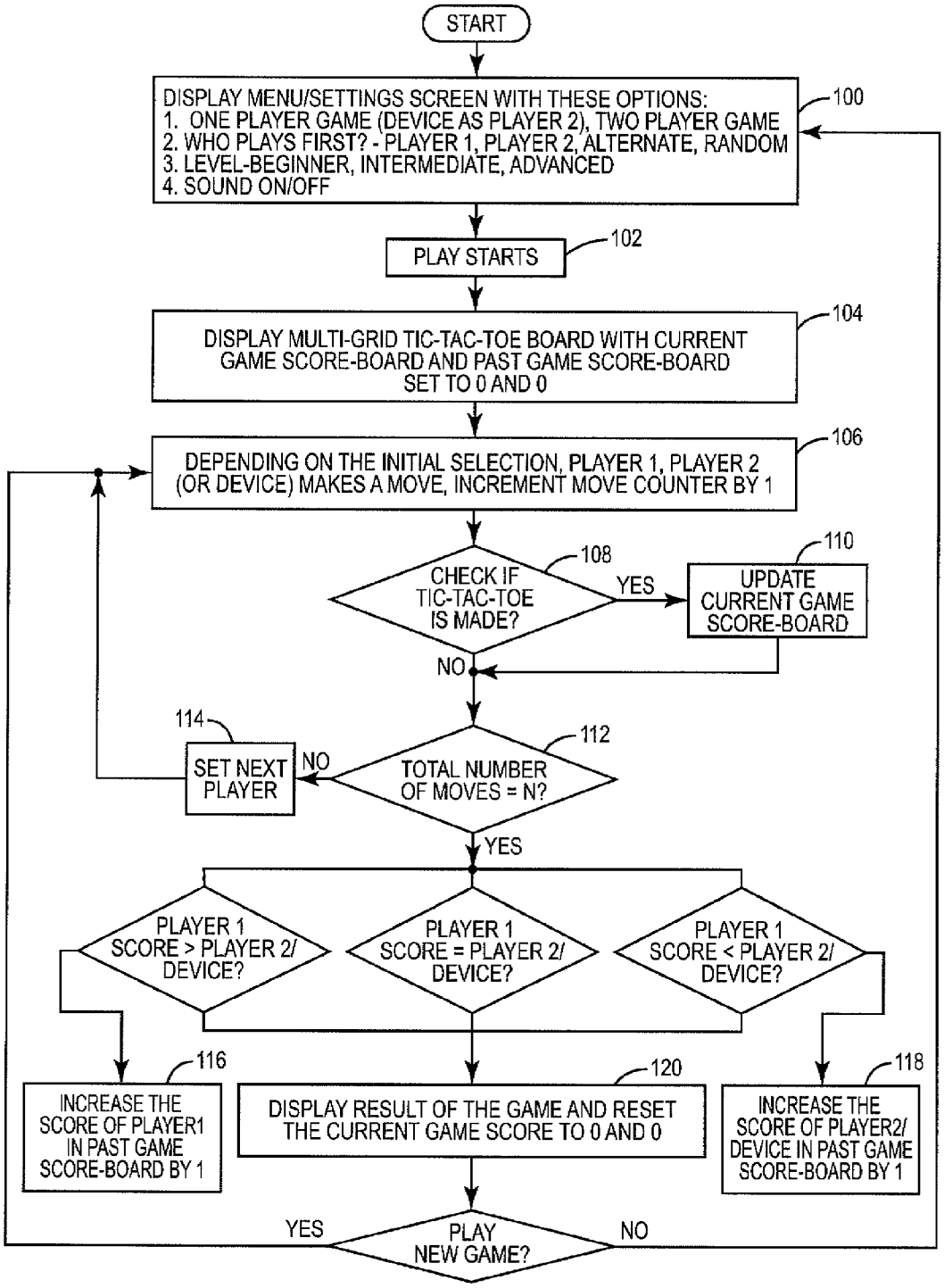
FIG. 22 is a logic flow diagram illustrating additional processing details performed in accordance with the computer program product of FIG. 16.

FIG. 22 describes additional processing details implemented by some embodiments of the computer program code. In these embodiments, the code causes the device 70 to display the current game score (in terms of points), past game results (in terms of how many previous tic-tac-toe games each player has won), the number of remaining moves until the winner is declared, and which player has the current turn. As shown in FIG. 22, block 100 depicts initialization options for the tic-tac-toe game. As noted therein, the settings can configure the number of players and which player has the first move. In the case where there is one player playing against what is generally referred to as the computer, the settings also configure the level of difficulty, e.g., among beginner, intermediate, and advanced.

Continuing with FIG. 22, block 102 indicates that play starts. Once play is started, the computer program code causes the device 70 to display the multi-grid tic-tac-toe game board as discussed above. In the illustrated embodiment, the code causes the device 70 to also initialize the current game score, as well as the past game score, to 0-0.

Processing continues to block 106, whereupon the game is started. The code causes the device 70 to accept input from one of the players associated with a tic-tac-toe move. The player may, for example, select a playing area via the user interface 78, which may comprise a touchscreen interface. The code causes the device 70 to record this move and to increment a move counter by 1.

Thereafter, the code causes the device 70 at block 108 to determine if the player's current move resulted in a tic-tac-toe, whether normal or super. In some embodiments, the code causes the device to store or otherwise have access to all possible scoring configurations of the multi-grid game board. Then, after each move, the code causes the device to survey the past moves and to determine if the current move resulted in a tic-tac-toe. If so, the code causes the device to determine the number of points that should be awarded (e.g., 1 for a normal tic-tac-toe and 2 for a super tic-tac-toe). If the code causes the device 70 to award one or more points (YES at block 108), the device 70 updates the current game scoreboard (Block 110).

After processing a player's current move, the code causes the device 70 to determine if the move counter has reached a predetermined number (e.g., 41 or 33). If not (NO at Block 112), then play proceeds to the next player (Block 114). If so (YES at Block 112), then the code causes the device 70 to determines the winner of the game. In the case of two players, player 1 and player 2, if player 1's score is greater than player 2 for the game that has just been completed, then the device 70 increases the score of player 1 in the past game scoreboard by 1 (Block 116). Likewise, if player 1's score is less for the preceding game than that of player 2, then the device 70 increases the score of player 2 in the past game scoreboard by 1 (Block 118). Finally, the device 70 resets the current game score to 0-0 (Block 120), before presenting the players the option of whether or not to play again.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A multi-grid tic-tac-toe game apparatus comprising a plurality of individual tic-tac-toe grids, each of the individual tic-tac-toe grids including a plurality of playing areas configured to receive playing pieces, and at least one of the individual tic-tac-toe grids sharing at least one common playing area with another one of the individual tic-tac-toe grids.

2. The multi-grid tic-tac-toe game apparatus of claim 1, wherein said at least one of the individual tic-tac-toe grids overlaps a portion of said another one of the individual tic-tac-toe grids.

3. The multi-grid tic-tac-toe game apparatus of claim 1, wherein the plurality of individual tic-tac-toe grids includes two or more peripheral tic-tac-toe grids as well as a central tic-tac-toe grid disposed in the center of the peripheral tic-tac-toe grids, the central tic-tac-toe grid sharing at least one common playing area with each peripheral tic-tac-toe grid.

4. The multi-grid tic-tac-toe game apparatus of claim 3, wherein the peripheral tic-tac-toe grids are spaced apart from one another.

5. The multi-grid tic-tac-toe game apparatus of claim 3, wherein any two peripheral tic-tac-toe grids share at most one common playing area with each other.

6. The multi-grid tic-tac-toe game apparatus of claim 3, wherein the plurality of individual tic-tac-toe grids includes four peripheral tic-tac-toe grids and one central tic-tac-toe grid.

7. The multi-grid tic-tac-toe game apparatus of claim 3, wherein each individual tic-tac-toe grid includes n rows of n playing areas each, wherein any given peripheral tic-tac-toe grid shares n common playing areas with the central tic-tac-toe grid, wherein a first one of those n common playing areas is also shared with a first peripheral tic-tac-toe grid, a second one of the n common playing areas is also shared with a second peripheral tic-tac-toe grid, and a third one of the n common playing areas is not shared with any peripheral tic-tac-toe grid.

8. The multi-grid tic-tac-toe game apparatus of claim 1, wherein said at least one common playing area comprises a corner playing area of both of said individual tic-tac-toe grids.

9. The multi-grid tic-tac-toe game apparatus of claim 1, wherein the plurality of individual tic-tac-toe grids comprises five individual tic-tac-toe grids.

10. The multi-grid tic-tac-toe game apparatus of claim 1, wherein each individual tic-tac-toe grid includes 9 playing areas arranged in 3 rows of 3 playing areas each.

11. The multi-grid tic-tac-toe game apparatus of claim 10, wherein the individual tic-tac-toe grids collectively include 41 playing areas, with 4 of those playing areas being common playing areas that are shared between 4 different pairs of individual tic-tac-toe grids.

12. The multi-grid tic-tac-toe game apparatus of claim 10, wherein the individual tic-tac-toe grids collectively include 33 playing areas, with 8 of those playing areas being common playing areas, each of the 8 common playing areas being shared between two or more individual tic-tac-toe grids.

13. The multi-grid tic-tac-toe game apparatus of claim 1, wherein the plurality of individual tic-tac-toe grids comprises at least five individual tic-tac-toe grids, including four peripheral tic-tac-toe grids and one central tic-tac-toe grid disposed between the peripheral tic-tac-toe grids, the central tic-tac-toe grid including four outer corner playing areas that also constitute four inner corner playing areas of the four peripheral tic-tac-toe grids.

14. The multi-grid tic-tac-toe game apparatus of claim 13, wherein the five individual tic-tac-toe grids include at least two diagonal lines of playing areas, each diagonal line of playing areas comprising at least three aligned playing areas that span at least two of the peripheral tic-tac-toe grids and the central tic-tac-toe grid.

15. The multi-grid tic-tac-toe game apparatus of claim 13, wherein the five individual tic-tac-toe grids include at least four parallel lines of playing areas, each parallel line of playing areas comprising at least seven aligned playing areas that span at least two of the peripheral tic-tac-toe grids and the central tic-tac-toe grid.

16. A computer program product stored on a computer readable medium tangible and comprising computer program code that, when executed by a processor associated with a computing device, causes the computing device to implement a tic-tac-toe game between at least two players, by causing the computing device to:

display a multi-grid tic-tac-toe game board on a viewing surface, the multi-grid tic-tac-toe game board comprising a plurality of individual tic-tac-toe grids, each of the individual tic-tac-toe grids including a plurality of playing areas, and at least one of the individual tic-tac-toe grids sharing at least one common playing area with another one of the individual tic-tac-toe grids;

alternately accept from said players input associated with tic-tac-toe moves, the input associated with a player's tic-tac-toe move comprising a selection of one of said playing areas; and responsive to input from a player, determine, based on any of that player's previous tic-tac-toe moves as recorded in a memory, whether the player's current tic-tac-toe move results in one or more tic-tac-toes.

17. The computer program product of claim 16, wherein the computer program code causes the computing device to determine whether the player's current tic-tac-toe move results in one or more tic-tac-toes, by determining that the move results in a tic-tac-toe if the player has selected a predetermined number of adjacent playing areas that are aligned, irrespective of whether those playing areas belong to different individual tic-tac-toe grids.

18. The computer program product of claim 16, wherein the computer program code further causes the computing device to:

award points to respective players for tic-tac-toes formed;

accumulate each player's points over one or more tic-tac-toes; and determine the winner of said tic-tac-toe game as the player with the most points accumulated.

19. The computer program product of claim 18, wherein the plurality of individual tic-tac-toe grids includes two or more peripheral tic-tac-toe grids as well as a central tic-tac-toe grid disposed in the center of the peripheral tic-tac-toe grids, and wherein the computer program code causes the computing device to award:

a first number of points to a player if that player forms a normal tic-tac-toe comprising a predetermined number of adjacent playing areas that are aligned, irrespective of whether those playing areas belong to different individual tic-tac-toe grids; and a second number of points to a player if that player forms a super tic-tac-toe comprising a predetermined number of non-adjacent playing areas that are aligned but belong to different individual tic-tac-toe grids.

20. The computer program product of claim 16, wherein said at least one of the individual tic-tac-toe grids overlaps a portion of said another one of the individual tic-tac-toe grids.

21. The computer program product of claim 16, wherein the plurality of individual tic-tac-toe grids includes two or more peripheral tic-tac-toe grids as well as a central tic-tac-toe grid disposed in the center of the peripheral tic-tac-toe grids, the central tic-tac-toe grid sharing at least one common playing area with each peripheral tic-tac-toe grid.

22. The computer program product of claim 16, wherein the peripheral tic-tac-toe grids are spaced apart from one another.

23. The computer program product of claim 16, wherein any two peripheral tic-tac-toe grids share at most one common playing area with each other.

24. The computer program product of claim 16, wherein at least one of said players is a computerized opponent, and wherein the computer program code further causes the computing device to accept input associated with tic-tac-toe moves of the computerized opponent in accordance with a difficulty level selected from a plurality of difficulty levels.

25. The computer program product of claim 16, wherein the computer program code further causes the computing device to track and display results of previous tic-tac-toe games played between said two or more players.

* * * * *